US010081941B2

(12) United States Patent
Timko et al.

(10) Patent No.: US 10,081,941 B2
(45) Date of Patent: Sep. 25, 2018

(54) WALL CLADDING SYSTEM AND METHOD

(71) Applicant: FRY REGLET CORPORATION, Santa Fe Springs, CA (US)

(72) Inventors: William J. Timko, Suwanee, GA (US); Mark E. Brinkman, Cumming, GA (US)

(73) Assignee: FRY REGLET CORPORATION, Santa Fe Springs, CA (US)

( * ) Notice: Subject to any disclaimer, the term of this patent is extended or adjusted under 35 U.S.C. 154(b) by 0 days.

(21) Appl. No.: 15/625,821

(22) Filed: Jun. 16, 2017

(65) Prior Publication Data

US 2017/0362824 A1 Dec. 21, 2017

Related U.S. Application Data

(60) Provisional application No. 62/352,840, filed on Jun. 21, 2016.

(51) Int. Cl.

| | |
|---|---|
| ***E04H 1/00*** | (2006.01) |
| ***E04H 3/00*** | (2006.01) |
| ***E04H 5/00*** | (2006.01) |
| ***E04H 6/00*** | (2006.01) |
| ***E04H 14/00*** | (2006.01) |
| ***E04B 2/74*** | (2006.01) |
| ***E04B 2/78*** | (2006.01) |
| ***E04B 2/76*** | (2006.01) |
| ***E04F 13/08*** | (2006.01) |

(52) U.S. Cl.

CPC ..... *E04B 2/7401* (2013.01); *E04B 2/768* (2013.01); *E04B 2/7881* (2013.01); *E04F 13/0821* (2013.01); *E04B 2002/742* (2013.01); *E04B 2002/7479* (2013.01); *E04B 2002/7487* (2013.01)

(58) Field of Classification Search

CPC ..... E04B 2/7401; E04B 2/768; E04B 2/7881; E04B 2002/742; E04B 2002/7479; E04B 2002/7487; E04F 13/0862; E04F 13/083; E04F 13/0821; E04F 13/0851; E04F 13/0803; E04F 13/0828; E04F 13/0839; E04F 13/0826

See application file for complete search history.

(56) References Cited

U.S. PATENT DOCUMENTS 3,117,353 A * 1/1964 Edwards ..... E04F 13/0835 248/225.21
3,359,700 A * 12/1967 Birum, Jr. ..... E04B 1/6112 52/459
3,621,635 A * 11/1971 DeLange ..... E04F 13/083 29/460
5,065,557 A * 11/1991 Laplante ..... E04B 2/96 52/235
5,694,727 A * 12/1997 Dobija ..... E04F 13/0826 52/287.1
6,202,377 B1 * 3/2001 Krieger ..... E04F 13/0812 52/489.1

(Continued)

*Primary Examiner* — Brian D Mattei

(74) *Attorney, Agent, or Firm* — Kilpatrick Townsend & Stockton LLP

(57) ABSTRACT

A wall cladding system includes a vertical support, a horizontal support, and a panel. The panel has a peripheral edge that abuts a first side surface of the vertical support and a top surface of the horizontal support. In various examples, a portion of the vertical support overlaps a portion of the horizontal support.

20 Claims, 21 Drawing Sheets

(56) References Cited

U.S. PATENT DOCUMENTS

| | | | | |
|---|---|---|---|---|
| 6,226,947 | B1 * | 5/2001 | Bado | E04F 13/0805 52/235 |
| 6,289,646 | B1 * | 9/2001 | Watanabe | E04F 13/0821 52/235 |
| 7,805,899 | B2 * | 10/2010 | Montgomery | E04F 13/081 52/235 |
| 7,849,651 | B2 * | 12/2010 | Fujito | E04F 13/0889 248/216.1 |
| 8,555,577 | B2 * | 10/2013 | Maday | E04L 32/00 52/235 |
| 8,584,417 | B1 * | 11/2013 | Krieger | E04F 13/0826 52/483.1 |
| 8,984,838 | B2 * | 3/2015 | Bordener | E04B 1/68 52/483.1 |
| 9,487,949 | B2 * | 11/2016 | Hager | E05L 365/006 |
| 9,506,252 | B2 * | 11/2016 | Molteni | A47F 5/0846 |
| 9,650,789 | B2 * | 5/2017 | Gulnick | E04F 13/0801 |
| 2003/0038222 | A1 * | 2/2003 | Holmes | A47G 1/1606 248/475.1 |
| 2006/0179764 | A1 * | 8/2006 | Ito | E04F 13/0821 52/506.06 |
| 2007/0022682 | A1 * | 2/2007 | Morgenegg | E04B 2/90 52/235 |
| 2013/0205698 | A1 * | 8/2013 | Todd | E04F 13/0805 52/302.1 |
| 2013/0269276 | A1 * | 10/2013 | Gaynor | E04F 13/083 52/506.05 |
| 2015/0007522 | A1 * | 1/2015 | Dobija | E04B 9/245 52/653.1 |
| 2015/0191912 | A1 * | 7/2015 | Bordener | E04F 13/0851 52/772 |
| 2016/0319552 | A1 * | 11/2016 | Aboukhalil | E04F 13/0816 |
| 2017/0022707 | A1 * | 1/2017 | Feldpausch | E04L 32/7455 |

* cited by examiner

WALL CLADDING SYSTEM AND METHOD

CROSS-REFERENCE TO RELATED APPLICATIONS

This application claims the benefit of U.S. Provisional Application No. 62/352,840, filed Jun. 21, 2016 and entitled WALL CLADDING SYSTEM AND METHOD, the content of which is hereby incorporated by reference in its entirety.

FIELD

This application relates to systems and methods for installing one or more panels onto a wall or another surface. More particularly, this invention relates to systems and methods for installing one or more modular panels onto a wall or other surface in a removable fashion.

BACKGROUND

Various wall covering systems are known in which a number of panels are installed onto a substrate to create a finished surface or other desired effects on the wall. Typically, installation of these panels occurs in a horizontally progressive manner. With horizontally progressive installation, the position of each panel is determined by the position of the previously installed horizontally adjacent panel, and the horizontally adjacent panels are attached to one another.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Examples of the invention covered by this patent are defined by the claims below, not this summary. This summary is a high-level overview of various examples of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

Embodiments relate to a wall cladding system comprised of unique panel support features designed to engage with each other and with panels to support panels on a wall without requiring direct attachment of the panels to each other.

Various implementations described in the present disclosure can include additional systems, methods, features, and advantages, which cannot necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following FIGS. are illustrated to emphasize the general principles of the present disclosure. Corresponding features and components throughout the FIGS. can be designated by matching reference characters for the sake of consistency and clarity.

DETAILED DESCRIPTION

Figure 1:
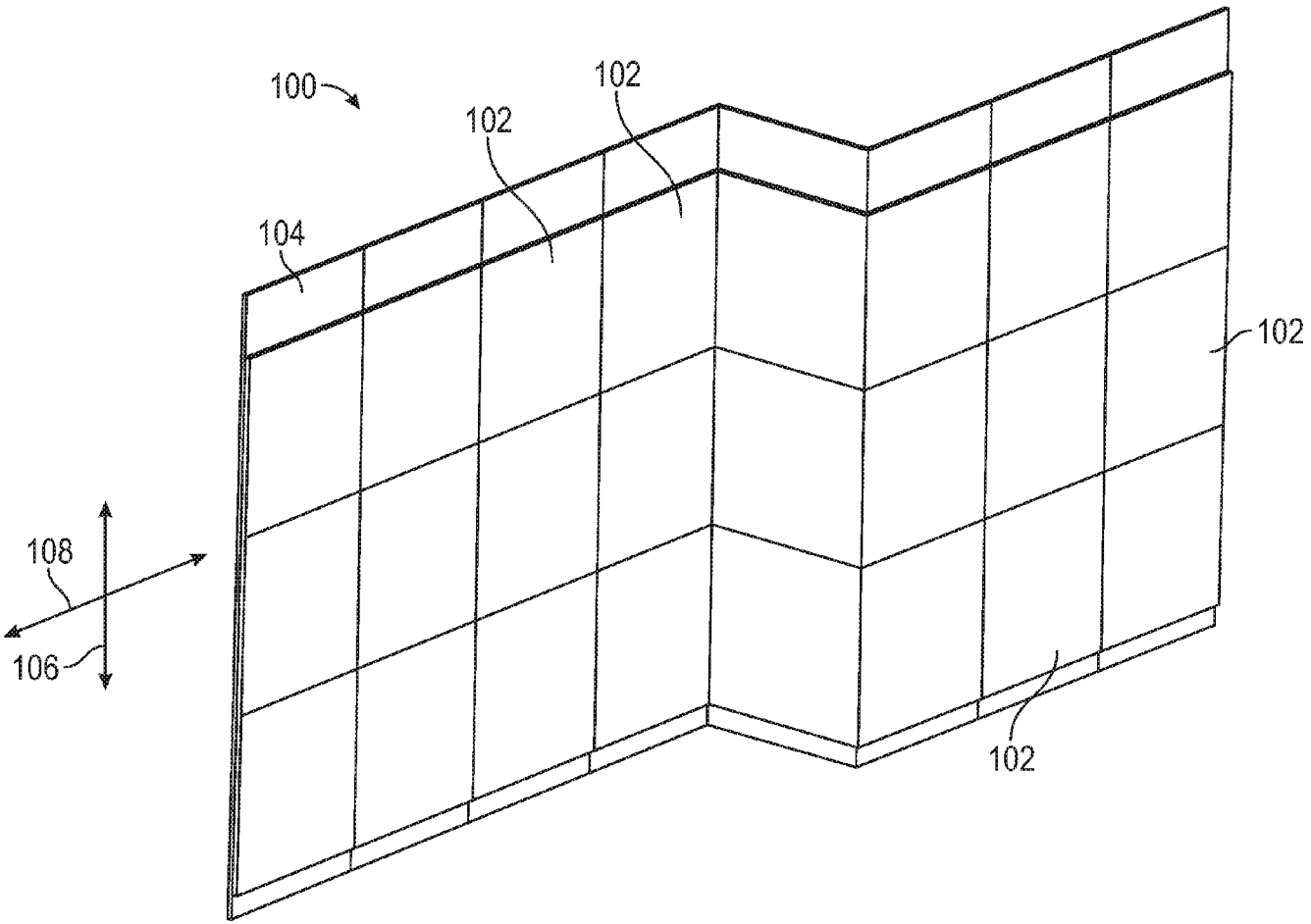
FIG. 1 is a perspective view of a wall cladding system according to an example of the current disclosure.

The subject matter of examples of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. Directional references such as "up," "down," "top," "left," "right," "front," "back," and "corners," among others are intended to refer to the orientation as illustrated and described in the figure (or figures) to which the components and directions are referencing. The term "substantially parallel" is used herein to mean parallel up to deviations caused by the manufacturing process that are acceptable within the wall-cladding industry. Similarly, the term "substantially perpendicular" is used herein to mean perpendicular up to deviations caused by the manufacturing process that are acceptable within the wall-cladding industry.

In one aspect, disclosed is a wall cladding system and associated methods, systems, devices, and various apparatus. The wall cladding system can comprise a vertical support, a horizontal support, and a panel. In some aspects, the wall cladding system has a reduced system depth, or distance from the panel to the surface on which the wall cladding system is secured, which provides more usable space that can be important in confined areas such as elevator cabs. In other aspects, the wall cladding system comprises overlapping joint details, which minimizes field cutting, notching, and shimming, and allows for faster installation of the wall cladding system. In various aspects, the panels of the wall cladding system can be pre-assembled to include horizontal trims and panel attachment profiles, which minimizes field labor required to install the wall cladding system. In certain aspects, the wall cladding system is vertically progressive in that panels of the wall cladding system are installed in a vertically progressive manner allowing for vertical framing and a horizontal bottom trim (support) to be installed prior to the receipt of panels at a worksite. After installation, the panels can be accessed vertically for ease of replacement. In further aspects, the panels of the wall cladding system can be phenolic panels that are highly abuse-resistant and can be provided in a variety of colors, patterns, and textures. In some aspects, the framing of the wall cladding system includes a bottom track that is slotted to facilitate base installation, which can allow a horizontal base support to be secured in an easy and faster manner. In various aspects, the framing of the wall cladding system includes expansion grooves that accommodate expansion and contraction of the panels, which may occur during environmental changes, without bowing or distorting the panels. In certain aspects, a top track of the wall cladding system can provide coverage of the tops of all panels, including un-level panels, to facilitate installation. It would be understood by one of skill in the art that the disclosed wall cladding system is described in but a few exemplary aspects among many.

As shown in FIG. 1, a wall cladding system 100 can comprise a plurality of panels 102 that are secured to a surface 104, such as a surface in airports, mass transit facilities, elevators, healthcare facilities, building lobbies, offices, and any other surfaces as desired. As described in detail below, the panels 102 are secured to the surface 104 via a framing system that includes a number of supports. In one aspect, it is contemplated that the wall cladding system 100 is vertically progressive in that adjacent panels 102 in the vertical direction 106 are supportively engaged while adjacent panels 102 in the horizontal direction 108 are not.

Figure 2A:
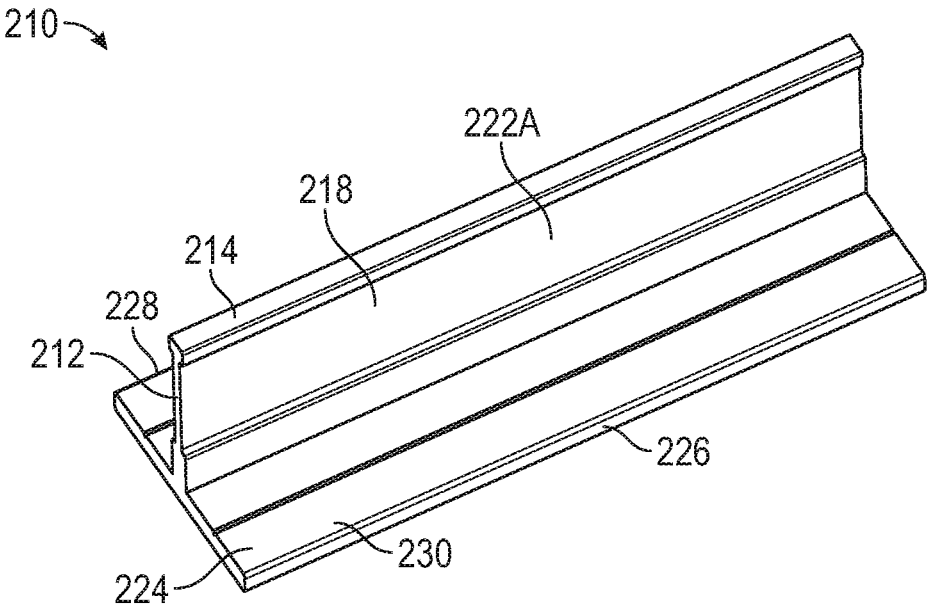
FIG. 2A is a perspective view of a vertical support of the wall cladding system of FIG. 1.
Figure 2B:
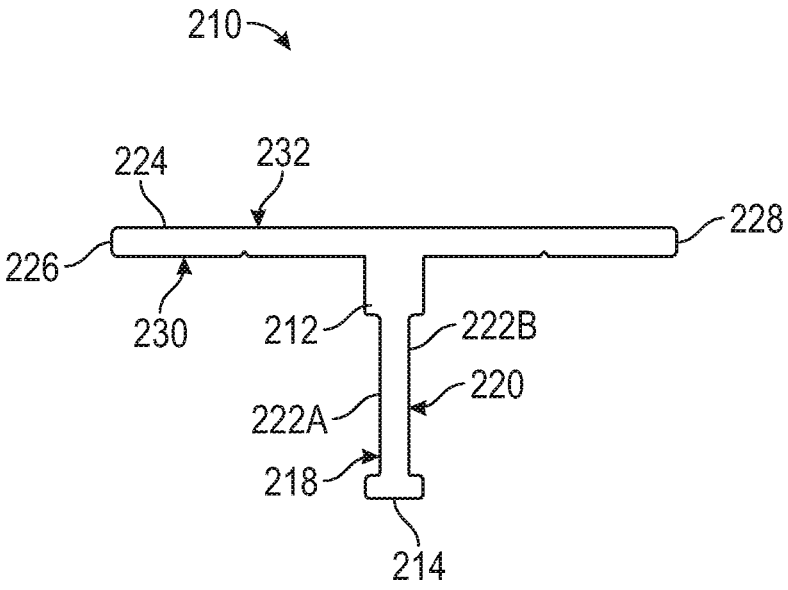
FIG. 2B is an end view of the vertical support of FIG. 2A.

Referring to FIGS. 2A-B, in some examples, the wall cladding system 100 includes a vertical support 210 having a base 224 from which an upstanding body 212 outwardly extends. The base 224 includes a first side edge 226, a second side edge 228, a front surface 230, and a back surface 232.

The upstanding body 212 extends outwardly from the front surface 230 of the base 224. In some examples, the upstanding body 212 extends substantially perpendicular to the base 224, although it can extend at non-orthogonal angles in other examples. The upstanding body 212 includes a top surface or edge 214, a first side surface 218, and a second side surface 220. In various examples, the first side surface 218 defines an expansion groove 222A that is dimensioned to accommodate the expansion and/or contraction of a panel 102 during environmental changes without bowing or distorting the panel 102. For example, in some aspects, the expansion groove 222A is dimensioned to receive at least a portion of a panel 102 within the expansion groove 222A when the panel 102 expands and/or contracts. In a similar manner, the second side surface 220 may also define an expansion groove 222B.

Figure 3B:
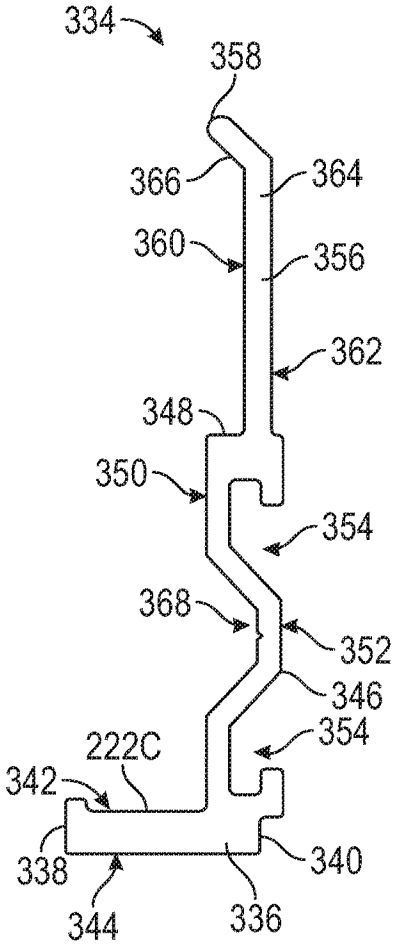
FIG. 3B is an end view of the horizontal support of FIG. 3A.
Figure 3A:
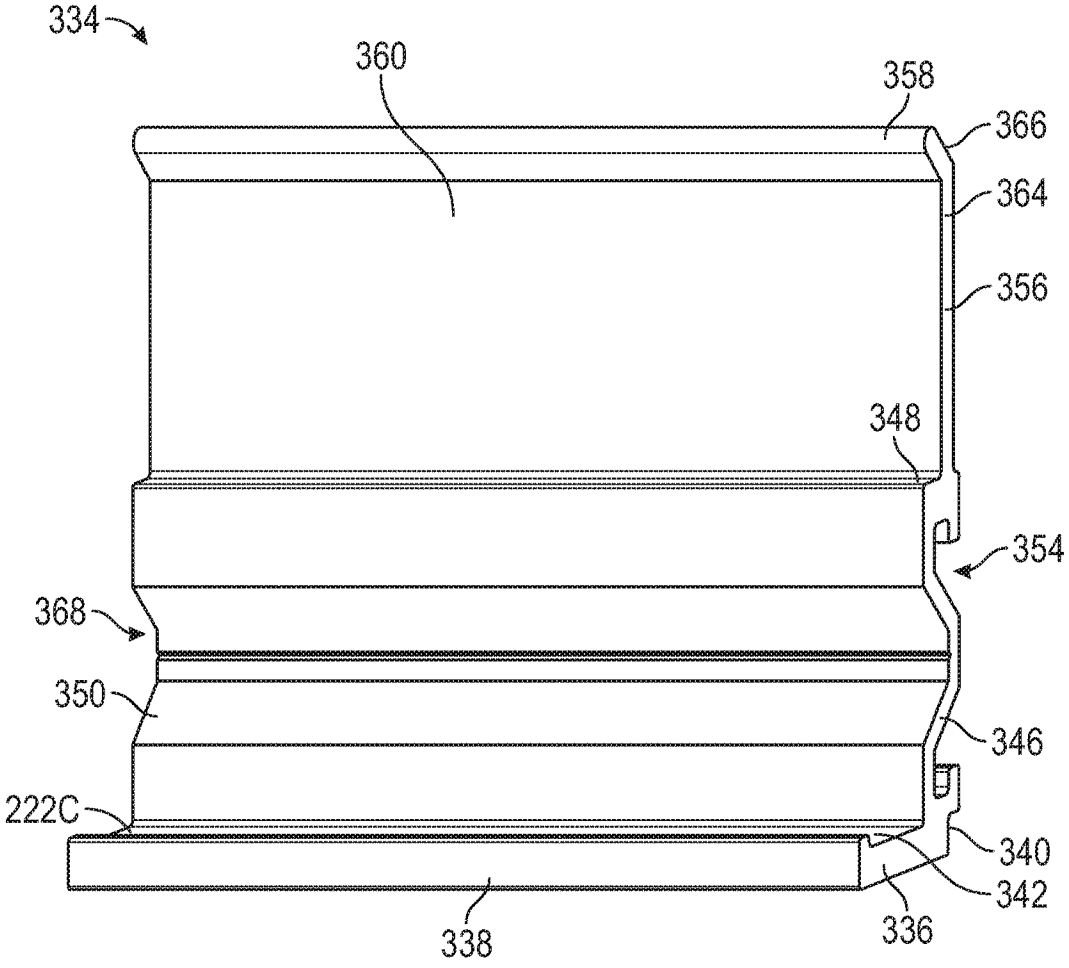
FIG. 3A is a perspective view of a horizontal support of the wall cladding system of FIG. 1.

Referring to FIGS. 3A-B, the wall cladding system 100 may include a horizontal support 334 having a body 336 with a front edge 338, a back edge 340, a top surface 342, and a bottom surface 344. Similar to the first side surface 218 of the vertical support 210, in some examples, the top surface 342 of the horizontal support 334 defines an expansion groove 222C.

In some examples, the horizontal support 334 includes a securing extension 346 extending from the top surface 342. In various aspects, the securing extension 346 can be proximate the back edge 340, although it need not be. The securing extension 346 includes a top edge 348, a front surface 350, and a back surface 352. In various examples, the back surface 352 defines a securing channel 354 that is dimensioned to receive a portion of a base track 470 within the securing channel 354, as described in detail below.

In various examples, the securing extension 346 generally extends in a direction that is substantially perpendicular to the top surface 342, and the front surface 350 and the back surface 352 are substantially perpendicular to the top surface 342, although they need not be. In various examples, the front surface 350 defines a securing groove 368, which is dimensioned to receive a portion of a fastener. In some aspects, the securing groove 368 extends in a direction that is substantially parallel to the top surface 342, although it need not. The securing groove 368 is dimensioned to receive a fastener within the securing groove 368 and through the securing extension 346 to secure the horizontal support 334 to the surface 104, as described in detail below.

In various examples, the horizontal support 334 also includes a support extension 356 extending from the top edge 348 of the securing extension 346. The support extension 356 has a top edge 358, a front surface 360, and a back surface 362. In some examples, the support extension 356 includes a first portion 364 proximate the top edge 348 of the securing extension 346 and a second portion 366 proximate the top edge 358. In various aspects, the first portion 364 is substantially perpendicular to the top surface 342 and the second portion 366 is oriented at a non-zero angle with respect to the first portion 364, although they need not be. In some cases, the front surface 360 and the back surface 362 at the first portion 364 are substantially perpendicular to the top surface 342, and the front surface 360 and the back surface 362 of the second portion 366 are oriented at a non-zero angle with respect to the first portion 364, although they need not be.

Figure 4A:
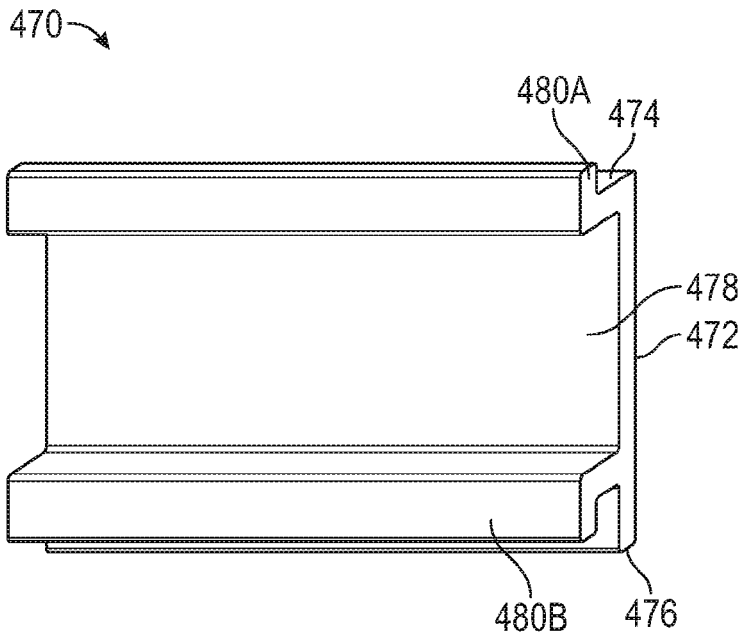
FIG. 4A is a perspective view of a base track of the wall cladding system of FIG. 1.
Figure 4B:
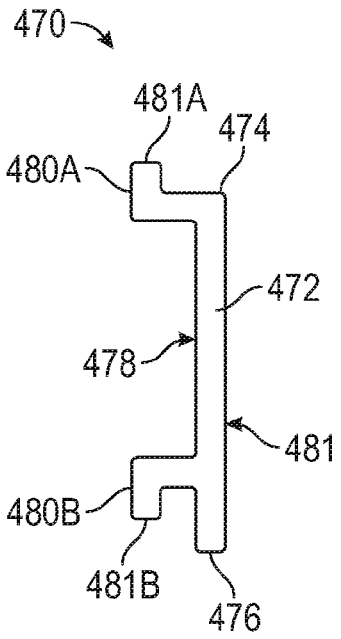
FIG. 4B is an end view of the base track of FIG. 4A.

Referring to FIGS. 4A-B, in various examples, the wall cladding system 100 includes a base track 470 having a body 472 with a top edge 474, a bottom edge 476, a front surface 478, and a back surface 481. In some examples, the base track 470 includes support extensions 480A-B extending from the front surface 478. The support extensions 480A-B are dimensioned to engage the securing channel 354 to position the horizontal support 334 on the base track 470. In various examples, the horizontal support 334 is slidable along the support extensions 480A-B. In some aspects, the support extension 480A is proximate the top edge 474 and the support extension 480B is between the top edge 474 and the bottom edge 476. In various examples, the support extensions 480A-B extend substantially perpendicular to the front surface 478, although they need not. Each support extension 480A-B may optionally include a lip 481A-B to aid in positioning the horizontal support 334 of the base track 470 such that the horizontal support 334 is slidable along the base track 470. The number, shape, or location of the support extensions 480 should not be considered limiting on the current disclosure.

Figure 5B:
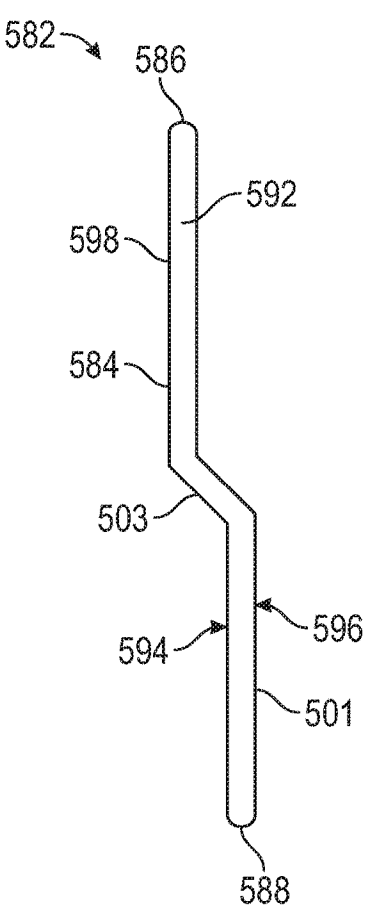
FIG. 5B is an end view of the joggle of FIG. 5A.
Figure 5A:
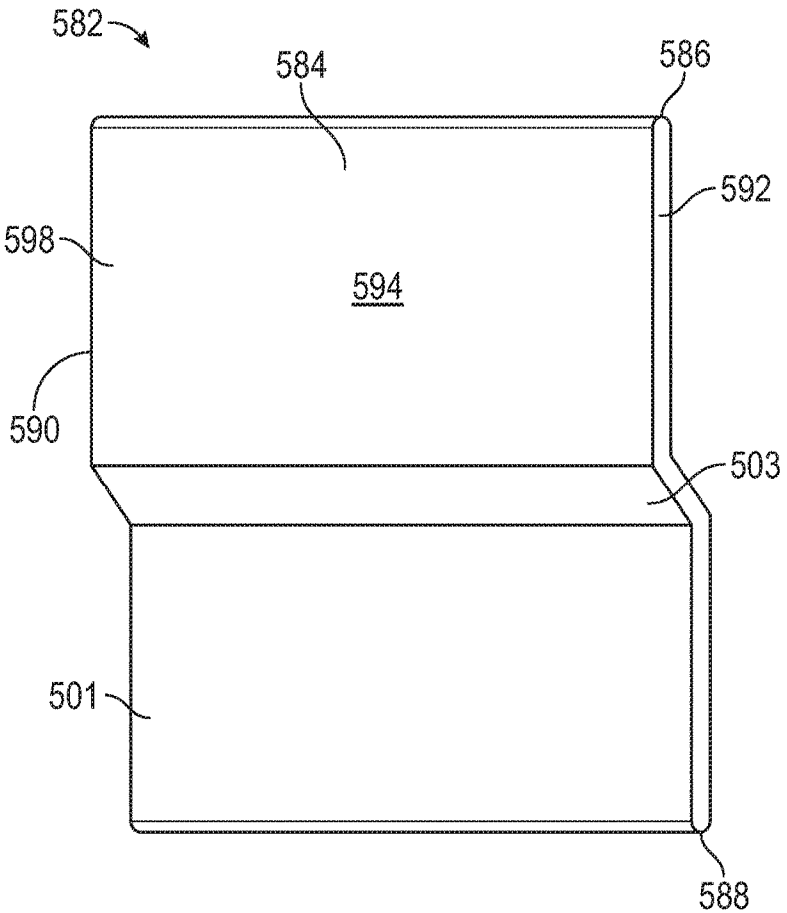
FIG. 5A is a perspective view of a joggle of the wall cladding system of FIG. 1.

Referring to FIGS. 5A-B, in some examples, the wall cladding system 100 includes a joggle 582. The number of joggles 582 should not be considered limiting on the current disclosure. In some aspects, the joggle 582 is secured on the surface 104 of the wall, on a surface of a panel 102, or on both. The joggle 582 includes a body 584 having a top edge 586, a bottom edge 588, a first side edge 590, a second side edge 592, a front surface 594, and a back surface 596. In various examples, the top edge 586 is offset from the bottom edge 588 such that the joggle 582 defines a first portion 598, a second portion 501, and a transition portion 503 between the first portion 598 and the second portion 501. In various examples, the first portion 598 is offset but parallel to the second portion 501, although it need not be. In other examples, the transition portion 503 is oriented at non-zero angles with respect to the first portion 598 and the second portion 501, although it need not be.

Figure 6A:
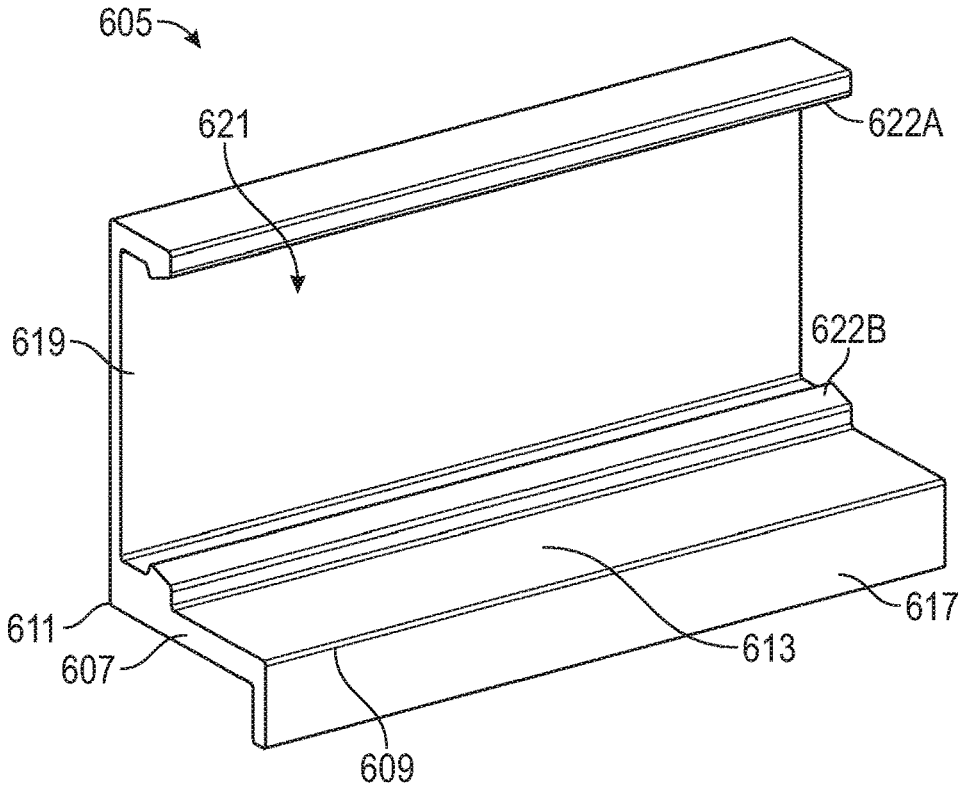
FIG. 6A is a perspective view of a top support of the wall cladding system of FIG. 1.
Figure 6B:
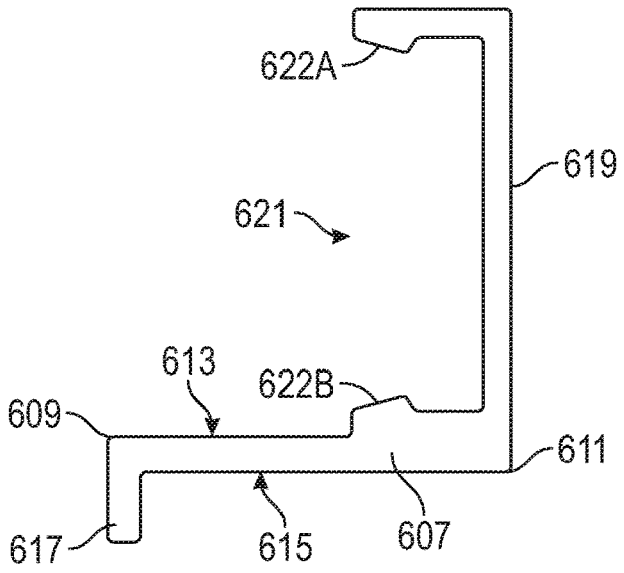
FIG. 6B is an end view of the top support of FIG. 6A.

Referring to FIGS. 6A-B, in some examples, the wall cladding system 100 includes a top support 605. The top support 605 includes a body 607 having a front edge 609, a back edge 611, a top surface 613, and a bottom surface 615. The top support 605 optionally includes a front lip 617 at the front edge 609 that extends in a downward direction. In some examples, the front lip 617 extends in a direction that is substantially perpendicular to the bottom surface 615, although it need not. In certain examples, the front lip 617 is configured to overlap a portion of a front surface 1246 of the panel 102 proximate to a top edge 1250 of the panel 102, as described in detail below. As illustrated in FIGS. 6A-6B, in various examples, the top support 605 also includes a cap backing 619. In certain aspects, the cap backing 619 extends in an upward direction that is substantially perpendicular to the top surface 613, although it need not be. The cap backing 619 defines a cap-securing channel 621 that is dimensioned to receive at least a portion of a cap 723 within the cap-securing channel 621, as described in detail below. Optionally, the cap securing channel 621 includes retaining edges 622A-B to aid in positioning the cap 723 within the cap-securing channel 621.

Figure 7:
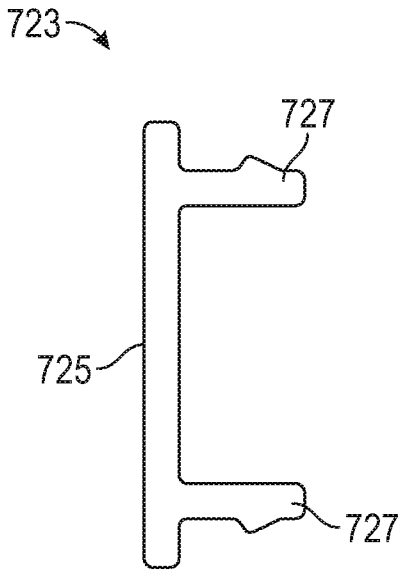
FIG. 7 is an end view of a cap of the wall cladding system of FIG. 1.

Referring to FIG. 7, the wall cladding system 100 optionally includes a cap 723 having a body 725 and cap extensions 727. The cap extensions 727 are configured to engage the cap-securing channel 621 such that the cap 723 is detachably secured to the top support 605. The number, shape, or location of the cap extensions 727 should not be considered limiting on the current disclosure.

Figure 8:
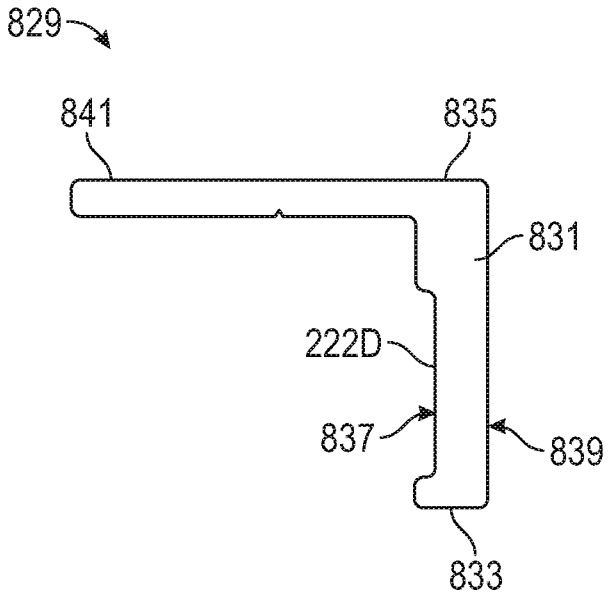
FIG. 8 is an end view of a vertical end of the wall cladding system of FIG. 1.

Referring to FIG. 8, a non-limiting example of a vertical end 829 of the wall cladding system 100 is illustrated. The vertical end 829 includes a body 831 having a front edge 833, a back edge 835, a first side surface 837, and a second side surface 839. In some aspects, the first side surface 837 defines an expansion groove 222D. As illustrated in FIG. 8, the vertical end 829 also includes a back flange 841 that ends from the body 831 proximate the back edge 835. In some aspects, the back flange 841 may be utilized with a fastener to secure the vertical end 829 to the surface 104.

Figure 9B:
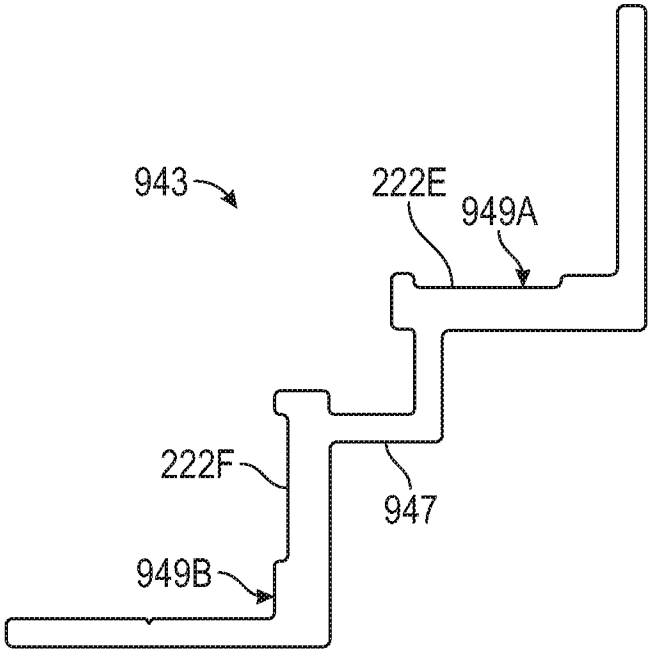
FIG. 9B is an end view of the interior corner of FIG. 9A.
Figure 9A:
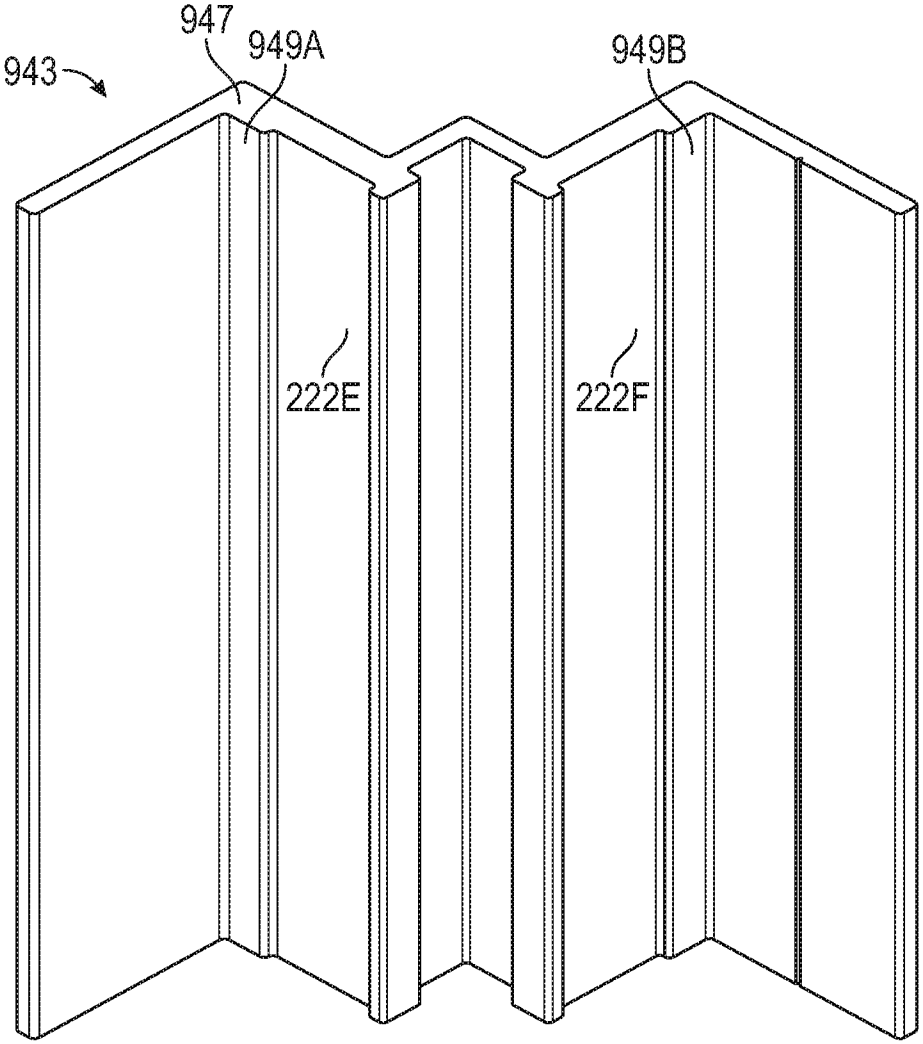
FIG. 9A is a perspective view of an interior corner of the wall cladding system of FIG. 1.
Figure 10B:
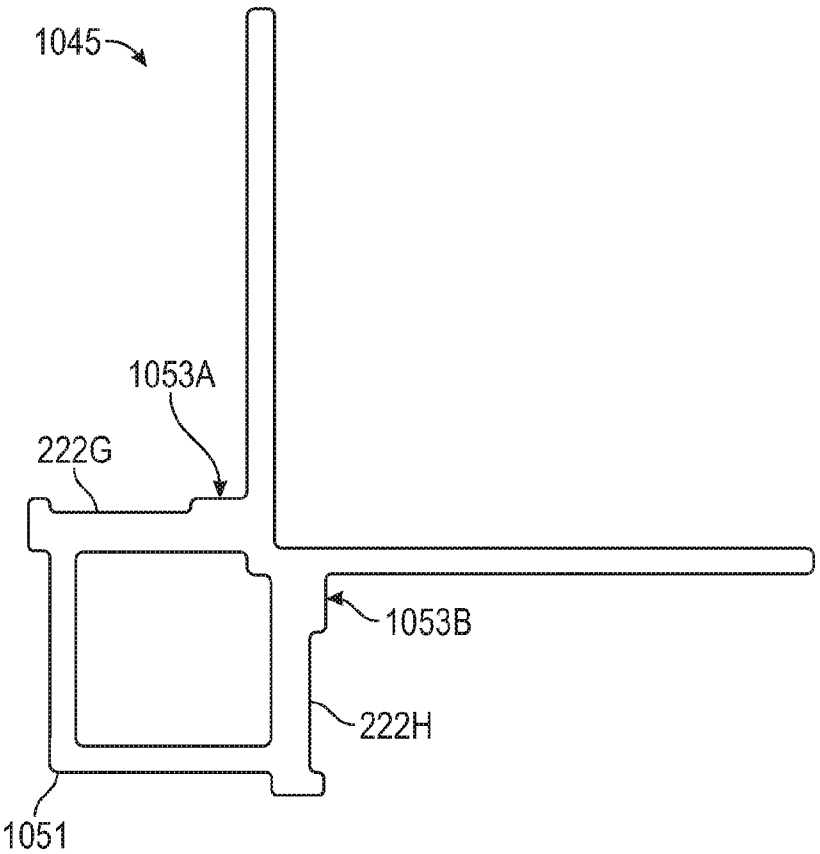
FIG. 10B is an end view of the exterior corner of FIG. 10A.
Figure 10A:
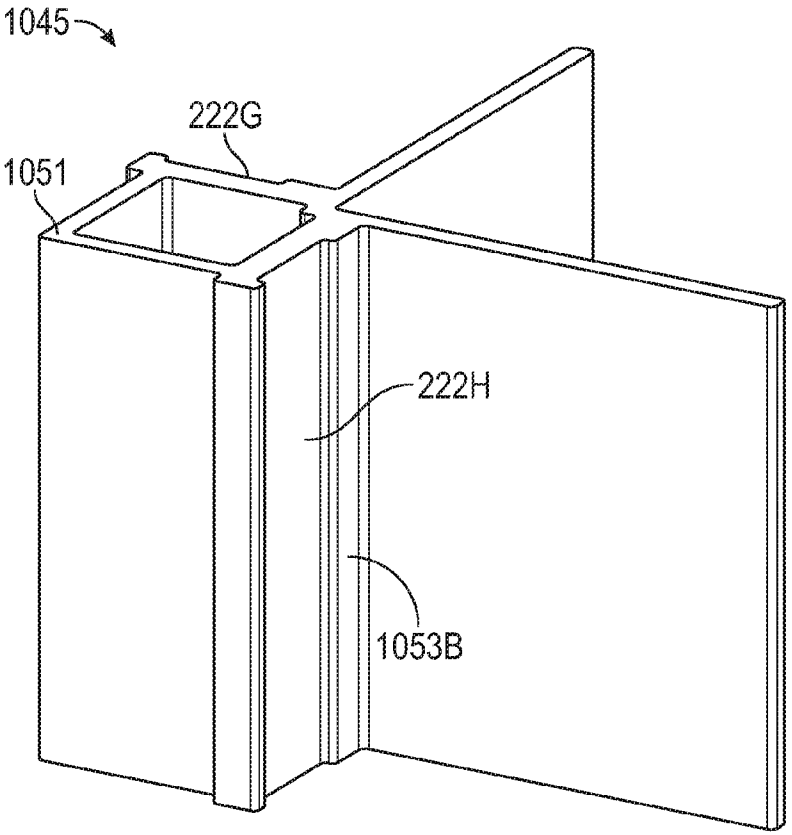
FIG. 10A is a perspective view of an exterior corner of the wall cladding system of FIG. 1.

Referring to FIGS. 9A-B and 10A-B, non-limiting examples of corners of the wall cladding system 100 are illustrated. In various aspects, the corners can be utilized to aid in installing adjacent panels 102 that are not coplanar because they are on surfaces that are curved, angled, or have various other shapes that are not planar, at locations where two surfaces meet, or at various other desired locations. For example, FIGS. 9A-B illustrate an interior corner 943 and FIGS. 10A-B illustrate an exterior corner 1045. The interior corner 943 has a body 947 that includes panel contact surfaces 949A-B. In various examples, each of the panel contact surfaces 949A-B defines an expansion groove 222E-F, respectively. Similarly, the exterior corner 1045 has a body 1051 that includes panel contact surfaces 1053A-B. In various examples, each of the panel contact surfaces 1053A-B defines an expansion groove 222G-H, respectively.

Figure 11A:
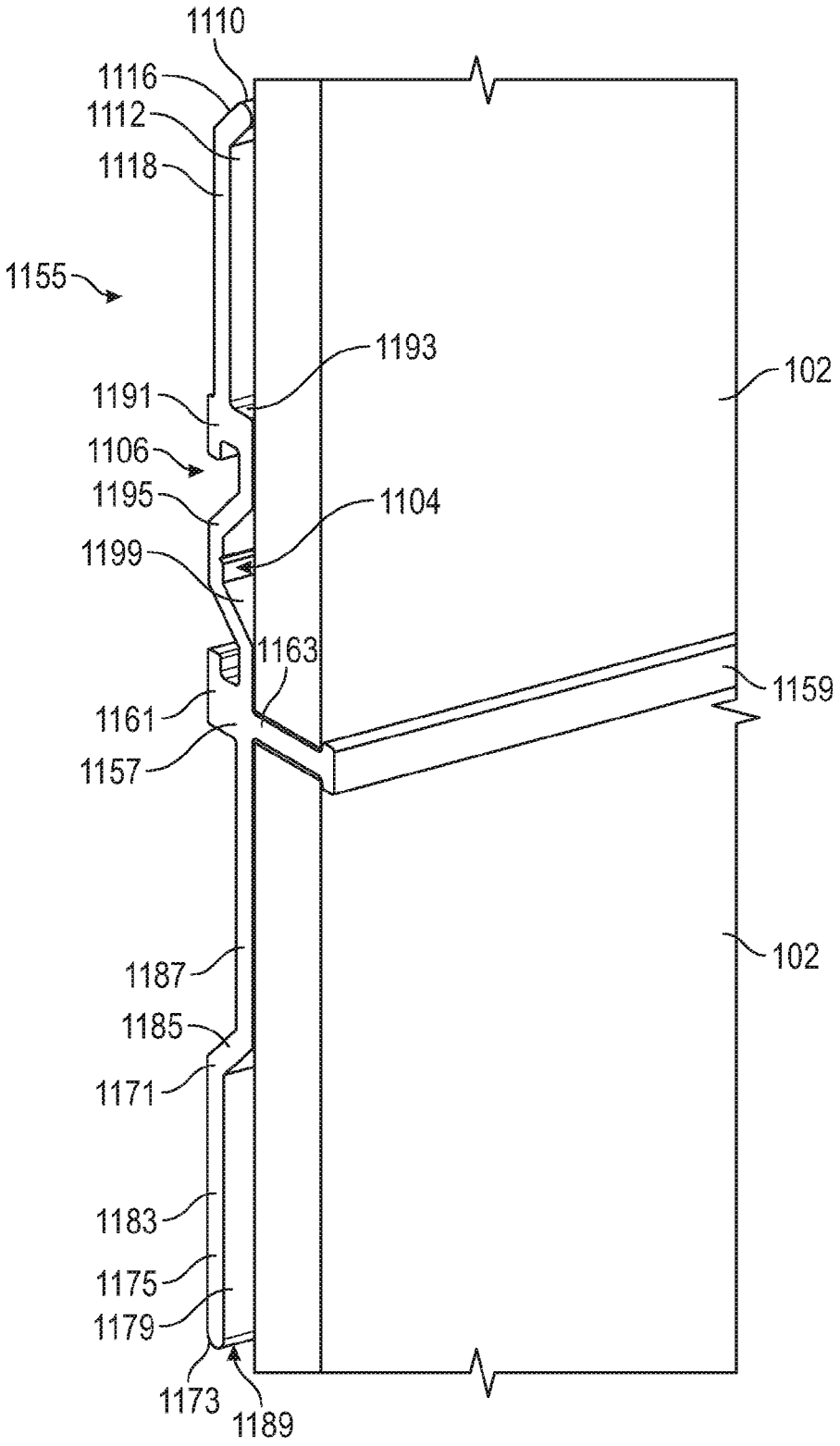
FIG. 11A is a perspective view of a panel support of the wall cladding system of FIG. 1.
Figure 11B:
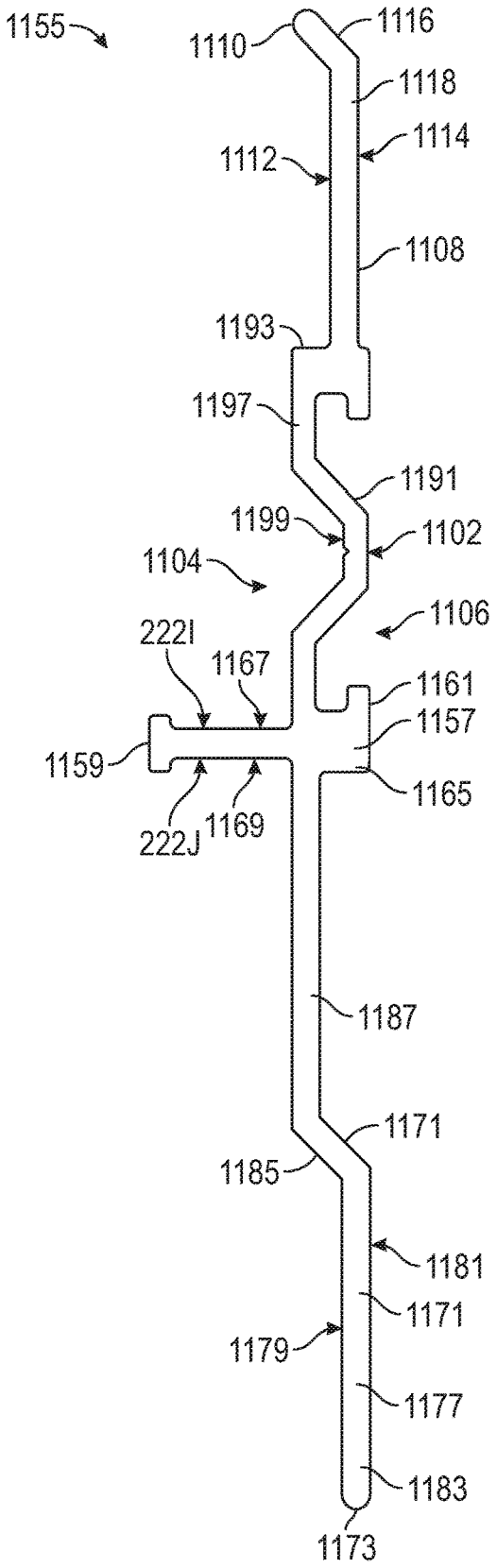
FIG. 11B is an end view of the panel support of FIG. 11A.

A panel support 1155 of the wall cladding system 100 is illustrated in FIGS. 11A-B. The panel support 1155 is configured to be positioned between two vertically adjacent panels 102. In some examples, the panel support 1155 is secured to the back surface 1248 of a lower of the two vertically adjacent panels 102, as described in detail below.

The panel support 1155 comprises a body 1157 having a front edge 1159, a back edge 1161, a first side edge 1163, a second side edge 1165, a top surface 1167, and a bottom surface 1169. Optionally, the top surface 1167 defines an expansion groove 2221 and/or the bottom surface 1169 defines an expansion groove 222J. In various examples, when the panel support 1155 is secured on adjacent vertical panel 102, the top surface 1167 abuts the bottom edge 1252 of the upper panel 102 and the bottom surface 1169 abuts the top edge 1250 of the lower panel 102 (see FIG. 11A).

In some examples, the panel support 1155 includes a joggle extension 1171 extending from the bottom surface 1169. In various examples, the joggle extension 1171 extends in a direction substantially perpendicular to the bottom surface 1169, although it need not. The joggle extension 1171 comprises a bottom edge 1173, a first side edge 1175, a second side edge 1177, a front surface 1179, and a back surface 1181. In some aspects, the joggle extension 1171 includes a first portion 1183, a second portion 1187, and a transition portion 1185 between the first portion 1183 and the second portion 1187. In some examples, as illustrated in FIGS. 11A-B, the first portion 1183 is laterally offset from the second portion 1187. However, in various other examples, the first portion 1183 is substantially parallel to the second portion 1187. In certain examples, the front surface 1179 of the joggle extension 1171 at the second portion 1187 abuts the back surface 1248 of the panel 102. In certain cases, the front surface 1179 of the joggle extension 1171 at the first portion 1183 is spaced apart from the back surface 1248 of the panel 102 such that a panel slot 1189 is defined between the front surface 1179 at the first portion 1183 and the back surface 1248 of the panel 102.

In various cases, the panel support 1155 includes a securing extension 1191 extending from the top surface 1167 of the body 1157 and having a top edge 1193, a first side edge 1195, a second side edge 1197, a front surface 1199, and a back surface 1102. As illustrated in FIGS. 11A-B, in various examples, the front surface 1199 defines a securing groove 1104 that is substantially similar to the securing groove 368, and the back surface 1102 defines a securing channel 1106 that is substantially similar to the securing channel 354. In various examples, the securing channel 1106 is dimensioned to receive at least a portion of a panel insert 1220 within the securing channel 1106, as described in detail below.

In some aspects, the panel support 1155 includes a support extension 1108 extending from the top edge 1193 of the securing extension 1191. The support extension 1108 includes a top edge 1110, a front surface 1112, and a back surface 1114. In some examples, the support extension 1108 comprises a first portion 1118 proximate the top edge 1193 of the securing extension 1191 and a second portion 1116 proximate the top edge 1110 of the support extension 1108. In various cases, the first portion 1118 is substantially perpendicular to the top surface 1167 of the body 1157, and the second portion 1116 is angled at a non-zero angle with respect to the first portion 1118, although they need not be. In some cases, the front surface 1112 and the back surface 1114 of the first portion 1118 are substantially perpendicular to the top surface 1167 of the body 1157, although they need not be. In certain examples, the front surface 1112 and the back surface 1114 of the second portion 1116 are oriented at a non-zero angle with respect to the first portion 1118, although they need not be.

Figure 12B:
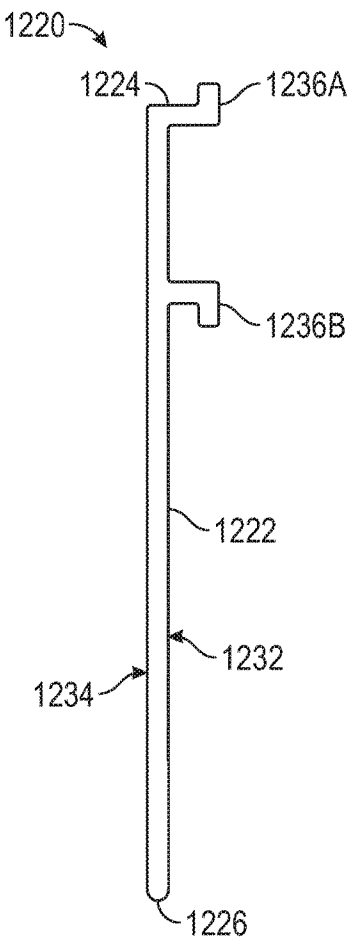
FIG. 12B is an end view of the panel insert of FIG. 12A.
Figure 12A:
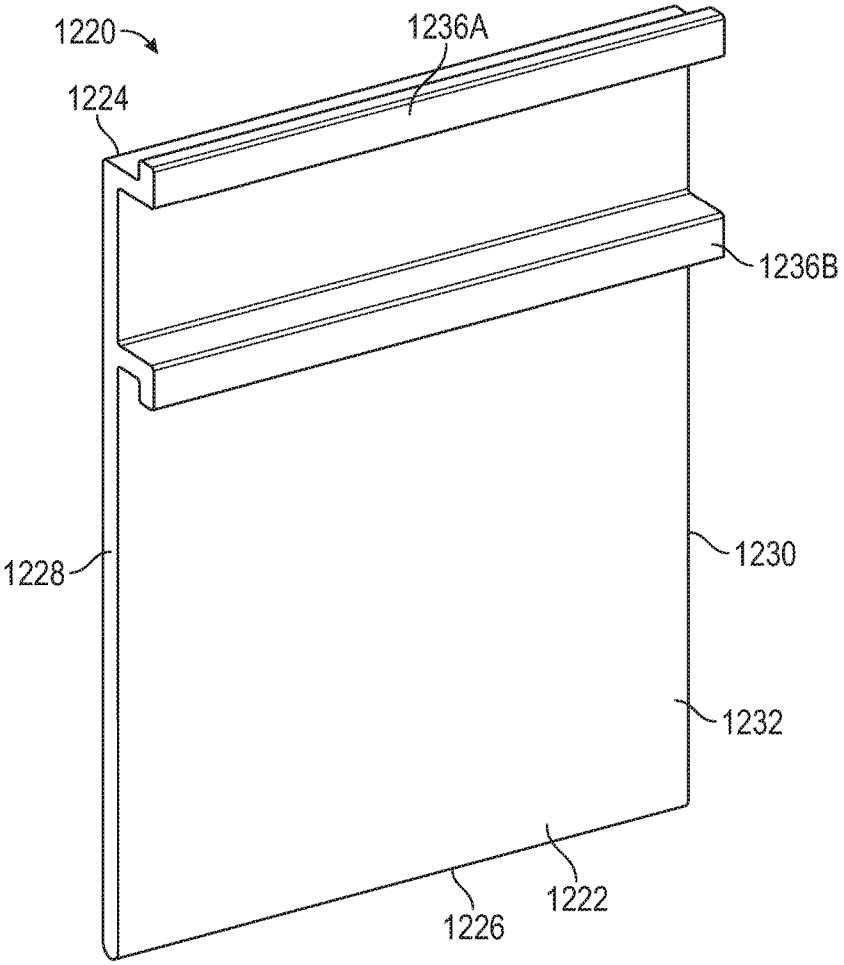
FIG. 12A is a perspective view of a panel insert of the wall cladding system of FIG. 1.

Referring to FIGS. 12A-B, in some examples, the wall cladding system 100 includes a panel insert 1220 having a body 1222 with a top edge 1224, a bottom edge 1226, a first side edge 1228, a second side edge 1230, a front surface 1232, and a back surface 1234. Securing extensions 1236A-B extend from the front surface 1232 and are configured to engage the securing channel 1106 of the panel support 1155 such that the panel insert 1220 is secured to the panel support 1155. In some cases, the panel insert 1220 is slidable along the securing channel 1106 until a fastener secures the panel insert 1220 at a desired position along the securing channel 1106. The number, location, or shape of the securing extensions 1236 should not be considered limiting on the current disclosure.

In some examples, at least a portion of the front surface 1232 proximate to the bottom edge 1226 is configured to abut a portion of the joggle extension 1171 of the panel support 1155. In certain cases, at least a portion of the joggle extension 1171 of the panel support 1155 and at least a portion of the body 1222 of the panel insert 1220 are positioned within a slot defined between the first portion 598 of the joggle 582 and the surface 104 to which the joggle 582 is attached.

Figure 13A:
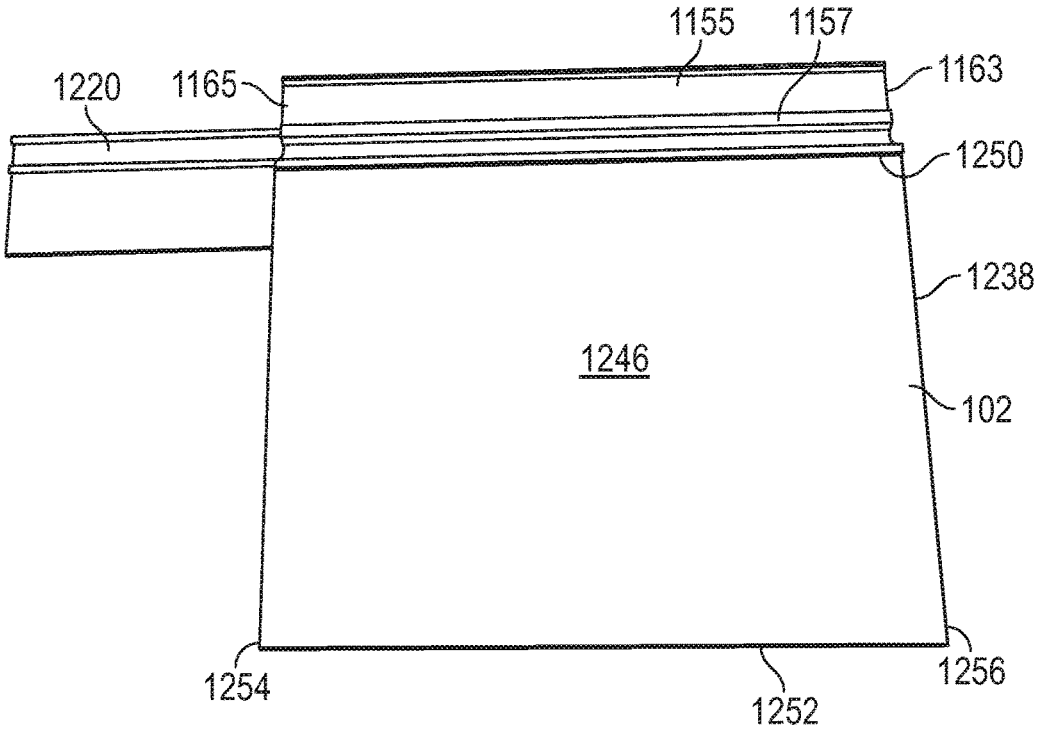
FIG. 13A is a front perspective view of a panel with the panel support of FIG. 11A and the panel insert of FIG. 12A.
Figure 13B:
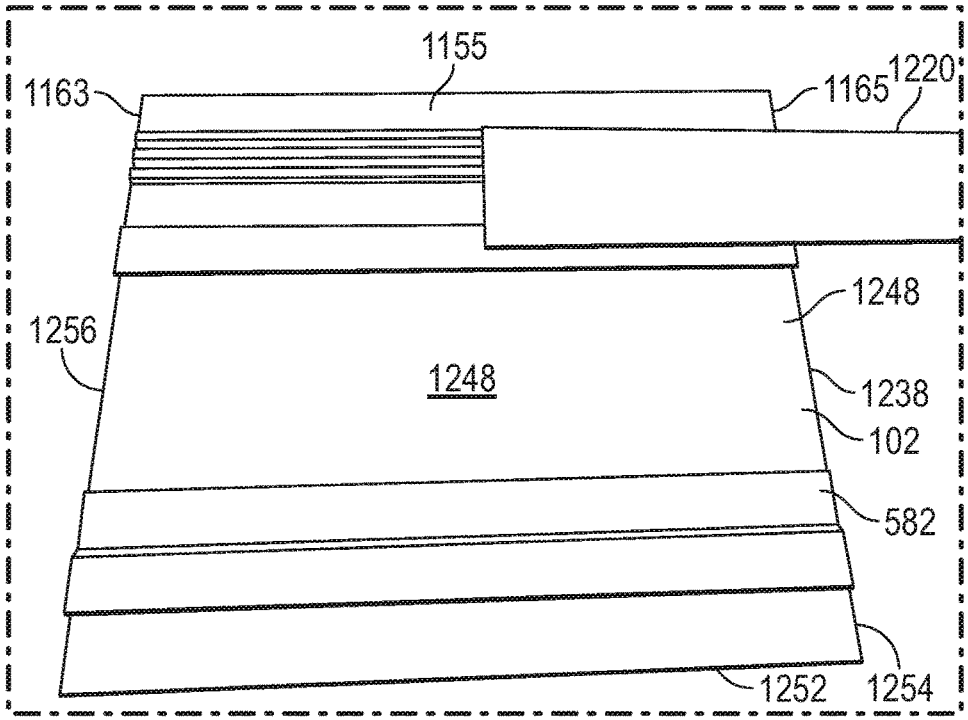
FIG. 13B is a back perspective view of the panel of FIG. 13A.

FIGS. 13A-B illustrate an example of the panel support 1155 secured on the panel 102 and the panel insert 1220 secured on the panel support 1155. As illustrated, the panel 102 has a peripheral edge 1238, a front surface 1246, and a back surface 1248. In various examples, the peripheral edge 1238 comprises a top edge 1250, a bottom edge 1252 distal from the top edge 1250, a first side edge 1254, and a second side edge 1256. In various examples, the bottom surface 1169 of the body 1157 of the panel support 1155 abuts a top edge 1250 of the panel 102 such that the body 1157 extends along the top edge 1250 (see also FIG. 11A). As illustrated in FIG. 13B, a joggle 582 has been secured to the back surface 1248 of the panel 102. In other examples, additional joggles 582 may be secured to the panel 102, and the panel support 1155 may be omitted (e.g., when the panel 102 is a top-most panel 102 in a column of panels 102 of the wall cladding system 100). Note an upper and lower joggle 582 need only be used for the top-most panels 102 in an installation. In some examples, the rest of the panels 102 in an installation need only be provided with a single joggle 582. In other examples, depending on the size of the panels 102, any suitable number of joggles 582 can be secured to the panel 102 and the surface 104 to ensure sufficient support for the panel 102.

FIGS. 14A-H illustrate a non-limiting example of a sequence of steps to install the wall cladding system 100. Mounting of panels 102 is described as proceeding in a vertically progressive manner, starting from the bottom of the installation; however, other installation methods are contemplated.

In one aspect, a method of assembling the wall cladding system 100 includes securing the vertical support 210 to the surface 104 such that the back surface 232 of the vertical support 210 is positioned against the surface 104. In some examples, one vertical support 210 is secured to start the assembly, and additional vertical supports 210 are secured as the panels 102 are installed and the wall cladding system 100 is built outwardly to the left and/or right. In other examples, all vertical supports 210 to be used in the wall cladding system 100 may be installed prior to the installation of the panels 102. A single vertical support 210 that extends the entirety of the desired height of the installation may be provided or, alternatively, multiple vertical supports 210 may be positioned to create the desired height. In some examples, the vertical support 210 is secured to the surface 104 through fasteners that are positioned through the base 224 and into the surface 104. In other examples, the fasteners can be adhesives, glues, or other suitable fastening mechanisms.

Figure 14A:
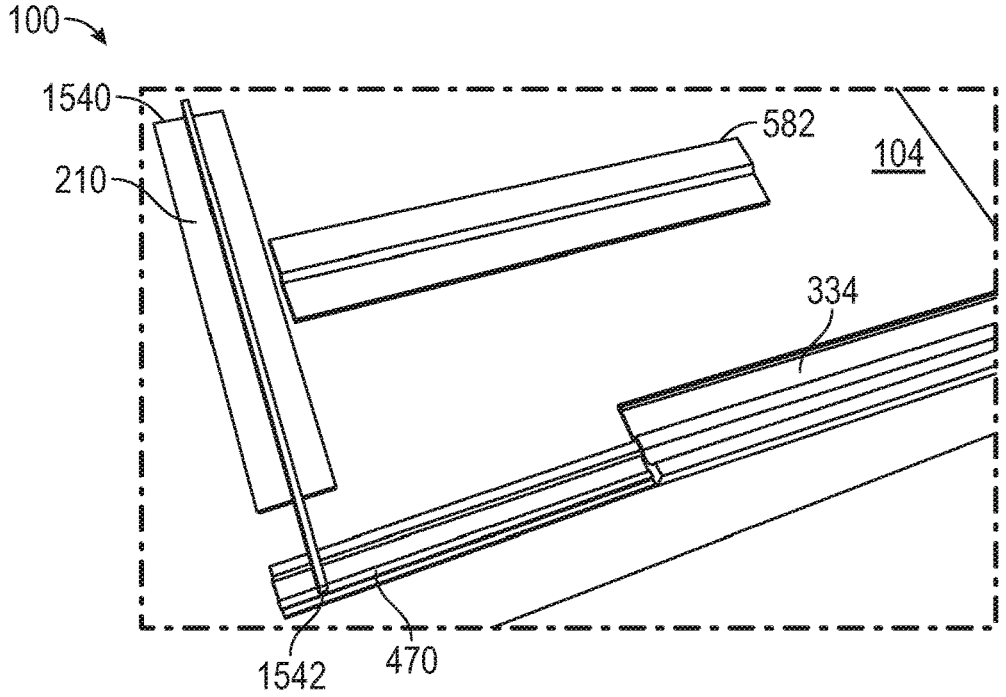
FIG. 14A is a perspective view of a vertical support, a horizontal support, a base track, and a joggle of the wall cladding system of FIG. 1 secured on a surface according to an example of the current disclosure.
Figure 14B:
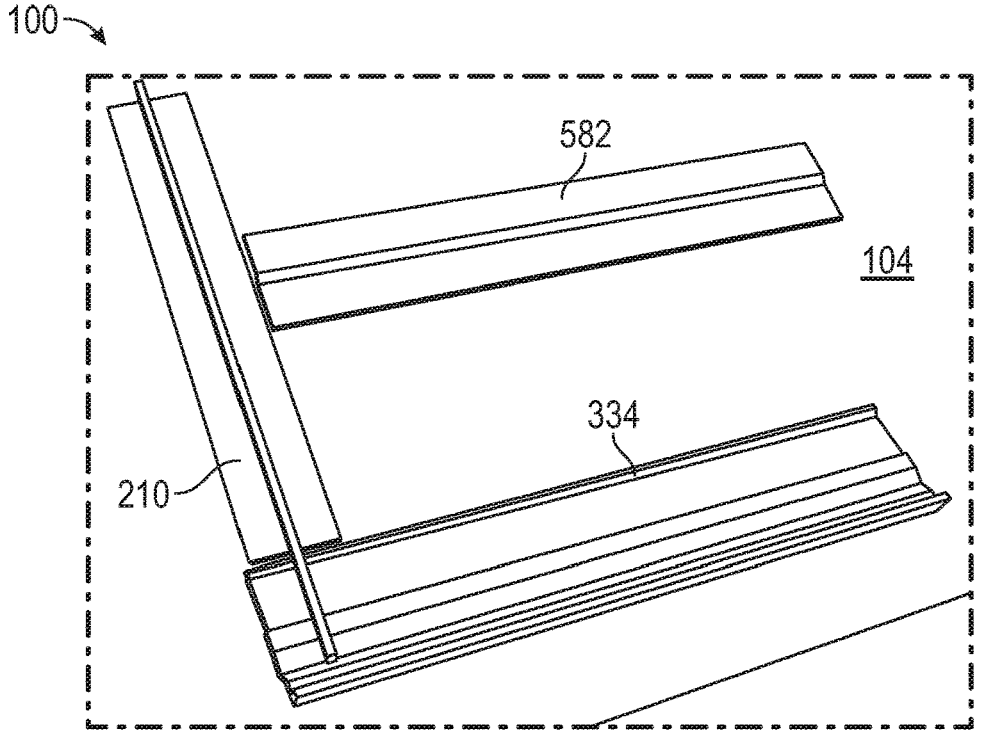
FIG. 14B is another perspective view of the wall cladding system of FIG. 14A.
Figure 14C:
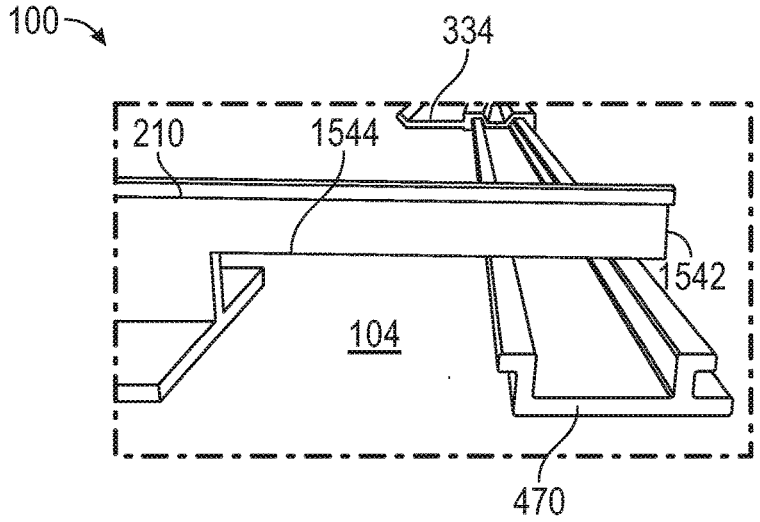
FIG. 14C is another perspective view of the wall cladding system of FIG. 14A.
Figure 14D:
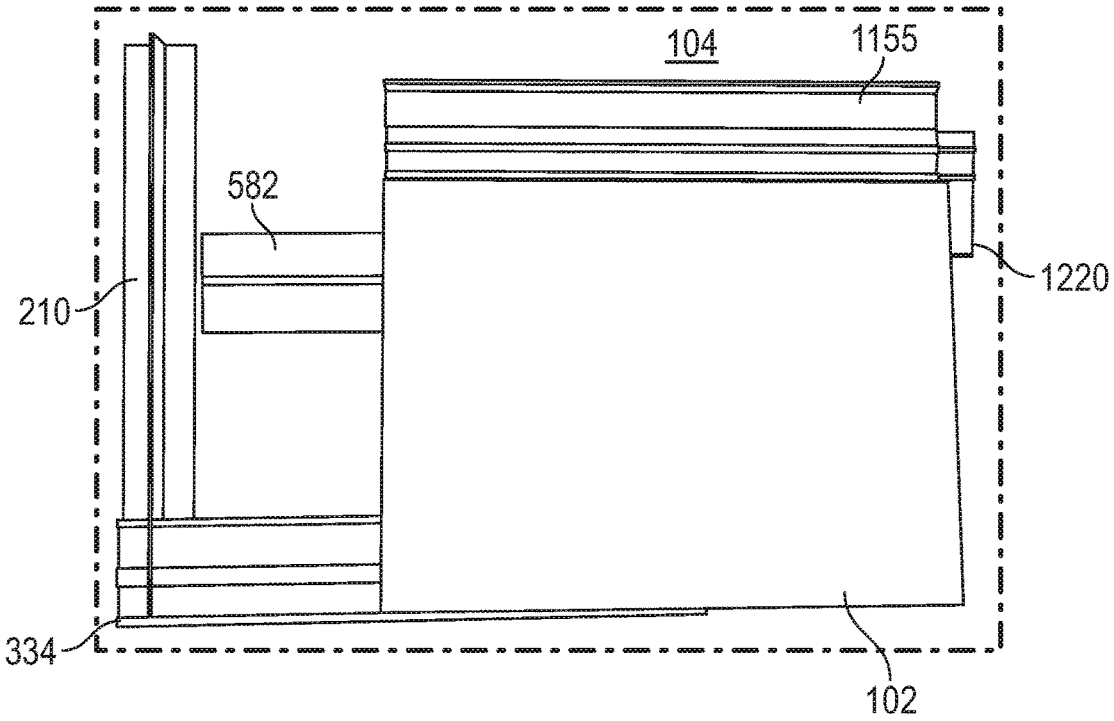
FIG. 14D is another perspective view of the wall cladding system of FIG. 14A.

Referring to FIGS. 14A-C, the vertical support 210 comprises a top edge 1540 and a bottom edge 1542. In some examples, the base 224 and a portion of the upstanding body 212 are optionally removed from the vertical support 210 proximate the bottom edge 1542 to define a cutout 1544. As illustrated in FIG. 14C, the cutout 1544 is dimensioned to receive at least a portion of the base track 470 and at least a portion of the horizontal support 334 such that the vertical support 210 overlaps the base track 470 and the horizontal support 334.

The method also includes positioning the base track 470 on the surface 104 such that the back surface 481 of the base track 470 is positioned against the surface 104. The base track 470 is positioned to extend along the bottom of the installation. Moreover, the base track 470 is typically, but does not have to be, provided in segments having approximately the same horizontal dimension of the panels 102 when installed. In other examples, the base track 470 can have smaller horizontal dimensions than the panels 102, or a single, continuous base track 470 can be provided for the entire width of the installation. As described in detail below, the base track 470 is provided as a shim to space the horizontal support 334 away from the surface 104 and allow the horizontal support 334 to be positioned as desired relative to the vertical support 210. In some examples, as illustrated in FIGS. 14A and 14C, the base track 470 is positioned such that a portion of the base track 470 extends through the cutout 1544 defined in the vertical support 210. The base track 470 is positioned such that the top edge 474 of the base track 470 is substantially perpendicular to the top edge 214 of the upstanding body 212 of the vertical support 210.

In various examples, the method also includes positioning the support extensions 480A-B of the base track 470 within the securing channel 354 of the horizontal support 334 to position the horizontal support 334 on the base track 470. A single horizontal support 334 may be positioned on a number of individual segments of base track 470 or on a single, continuous base track 470. Alternatively, multiple segments of horizontal supports 334 may be used.

Comparing FIG. 14B to FIG. 14A, the horizontal support 334 is slid along the base track 470 to a desired position. In some examples, the horizontal support 334 is slid along the base track 470 such that a portion of the horizontal support 334 is within the cutout 1544 defined in the vertical support 210 and a portion of the upstanding body 212 of the vertical support 210 overlaps a portion of the body 336 of the horizontal support 334 (see FIGS. 14B and 14D). The horizontal support 334 and base track 470 are secured to the surface 104 through fasteners that are positioned in the securing groove 368 of the horizontal support 334 and through the body 336 of the horizontal support 334 and the body 472 of the base track 470. In other examples, adhesives, glues, or other suitable fastening mechanisms may be utilized. When the horizontal support 334 is secured on the base track 470, the front edge 338 of the horizontal support 334 is substantially perpendicular to the top edge 214 of the upstanding body 212 of the vertical support 210. Additionally, when the horizontal support 334 is secured on the base track 470, a gap is defined between the back surface 362 of the support extension 356 of the horizontal support 334 and the surface 104.

The method can further include securing the joggle 582 to the surface 104. The joggle 582 may be secured through various securing mechanisms including, but not limited to, fasteners, adhesives, glues, pins, and various other suitable securing mechanisms. As illustrated in FIG. 14A, for example, the joggle 582 is secured such that the first side edge 590 of the joggle 582 is adjacent to the second side edge 228 of the vertical support 210. The second portion 501 of the joggle 582 is positioned proximate to the horizontal support 334 relative to the first portion 598 of the joggle 582. The back surface 596 of the second portion 501 of the joggle 582 is positioned against the surface 104 and the first portion 598 of the joggle 582 is spaced apart from the surface 104 through the transition portion 503 of the joggle 582. In this manner, a gap is defined between the back surface 596 of the first portion 598 of the joggle 582 and the surface 104. This gap is dimensioned to receive the second portion 1187 of the joggle extension 1171 of the panel support 1155 and a portion of the body 1222 of the panel insert 1220 when the panel 102 is mounted on the wall cladding system 100, as explained in more detail below.

In various examples, the method includes mounting the panel 102 on the surface 104. Prior to mounting, a joggle 582 is secured to the back side of the panel 102. Moreover, a panel support 1155 is also secured to the back surface 1248 of the panel 102. The securing extensions 1236A-B on the panel insert 1220 are slid into the securing channel 1106 on the panel support 1155 such that the panel support 1155 supports the panel insert 1220 (see FIGS. 13A-B). Provision of these various components on the panel 102 may be accomplished in the field or, alternatively, may be done in the factory and the panels 102 delivered ready to be installed.

When the panel support 1155 is mounted on the panel 102 and as apparent in FIG. 13A, the body 1157 of the panel support 1155 frames the top edge 1250 of the panel 102. Moreover, a portion of the panel support 1155 extends from the top edge 1250 of the panel 102. More specifically, the body 1157 of the panel support 1155 all the way to the top edge 1110 of the support extension 1108 of the panel support 1155 (see FIG. 11B, collectively the "exposed portion") extends from the top edge 1250 of the panel 102. The geometry of this exposed portion of the panel support 1155 is identical to the geometry of horizontal support 334 (compare FIGS. 11B and 3B). Thus, the exposed portion of the panel support 1155 extending from the top edge 1250 of a lower panel 102 serves as the horizontal support 334 for a panel 102 to be positioned above the lower panel 102.

In one example, to install a panel 102 (see FIGS. 14D-14G), the panel 102 is slid downwardly so as to engage the joggle 582 and the horizontal support 334 (or the exposed portion of the panel support 1155 extending from a lower panel 102 in the installation). As illustrated in FIG. 15B, the panel 102 is oriented so that the first portion 1183 of the joggle extension 1171 of the panel support 1155 and a portion of the body 1222 of the panel insert 1220 (both mounted on the panel 102—these are shown mounted on wall 104 in the figures) are positioned within the gap defined by the joggle 582 secured to the surface 104. Moreover, the joggle 582 mounted on the back of the panel 102 engages the horizontal support 334 (or the exposed portion of the panel support 1155 extending from a lower panel 102 in the installation). See FIG. 15C.

In examples where all of the vertical supports 210 are pre-installed, once the panel 102 is slid downwardly to engage the joggle 582 and the horizontal support 334 (or the exposed portion of the panel support 1155 extending from a lower panel 102 in the installation), the first side edge 1254 and second side edge 1256 of the panel 102 are positioned adjacent the upstanding bodies 212 of vertically adjacent vertical supports 210. In this way, the upstanding bodies 212 (and particularly the top surface or edge 214 of such upstanding bodies 212) frame the side edges 1254, 1256 of the panel 102.

Figure 14E:
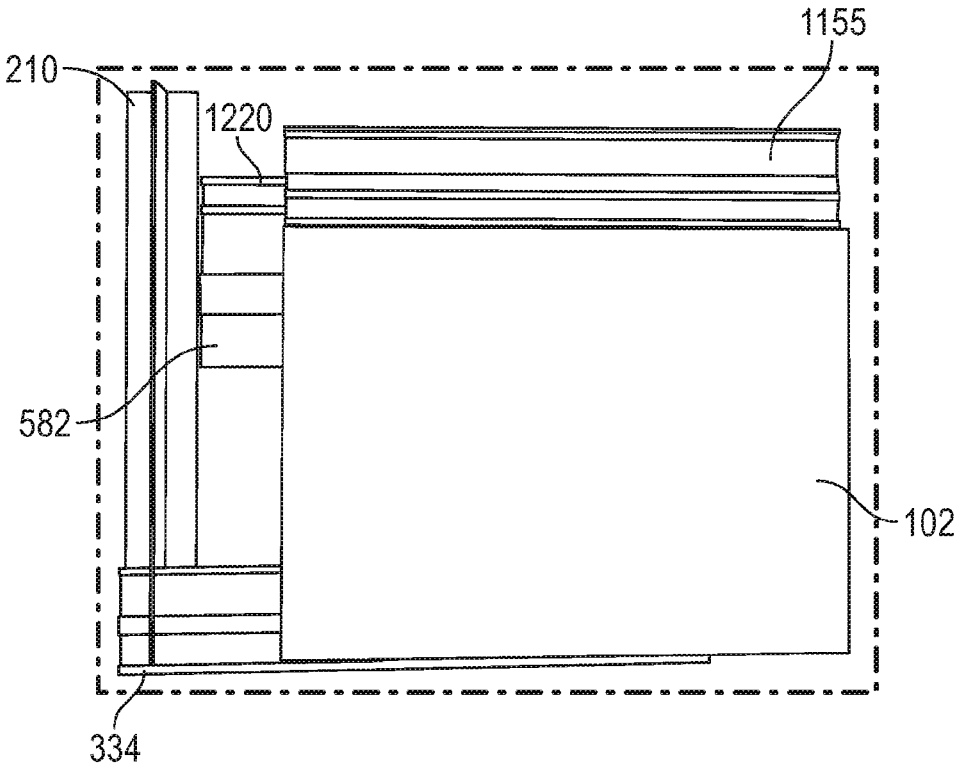
FIG. 14E is another perspective view of the wall cladding system of FIG. 14A.
Figure 14F:
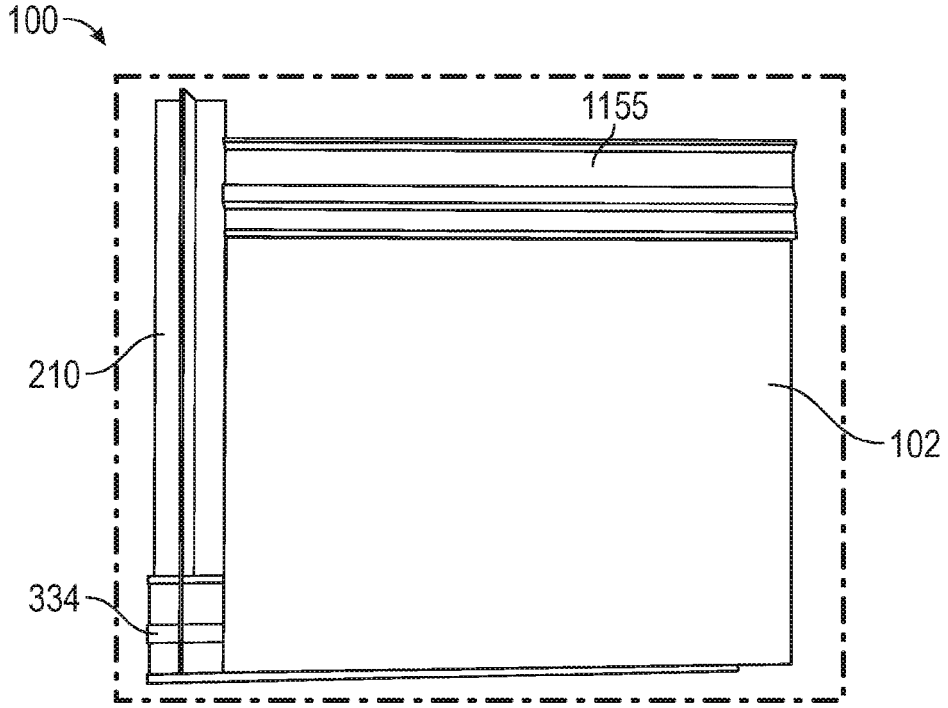
FIG. 14F is another perspective view of the wall cladding system of FIG. 14A.

In other examples where all of the vertical supports 210 are not pre-installed, the panel insert 1220 can be slid within the gap until the first side edge 1228 of the panel insert 1220 abuts the first side edge 226 of the base 224 of the vertical support 210, as illustrated for example in FIG. 14E. In this aspect, the front surface 230 of the base 224 of the vertical support 210 is coplanar with the front surface 1232 of the panel insert 1220, and a continuous surface is provided that the panel support 1155 can slide along. Moreover, the panel insert 1220 is typically, but does not have to be, provided in segments having a smaller horizontal dimension than that of the panels 102 when installed. In these examples, a single panel 102 may include multiple panel inserts 1220. In other examples, a single, continuous panel insert 1220 can be provided for a single panel 102.

The panel insert 1220 is provided as a shim to space the panel support 1155 away from the surface 104 and allow the panel 102 and panel support 1155 to be positioned as desired relative to the vertical support 210. See FIG. 15B. After the first side edge 1228 of the panel insert 1220 abuts the edge 228 of the base 224 of the vertical support 210, the panel 102 can still be moved along the panel insert 1220 (via engagement between the panel support 1155 and panel insert 1220) until the panel 102 is positioned proximate the upstanding body 212 of the vertical support 210, which frames the first side edge 1254 of the panel 102.

Figure 15A:
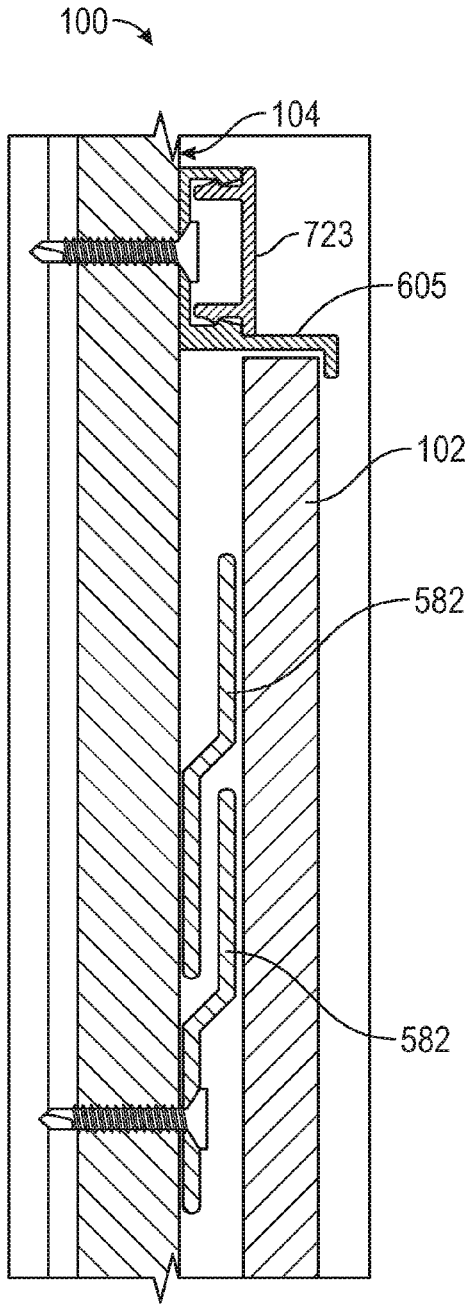
FIG. 15A is a sectional side end view of the wall cladding system of FIG. 1.
Figure 15B:
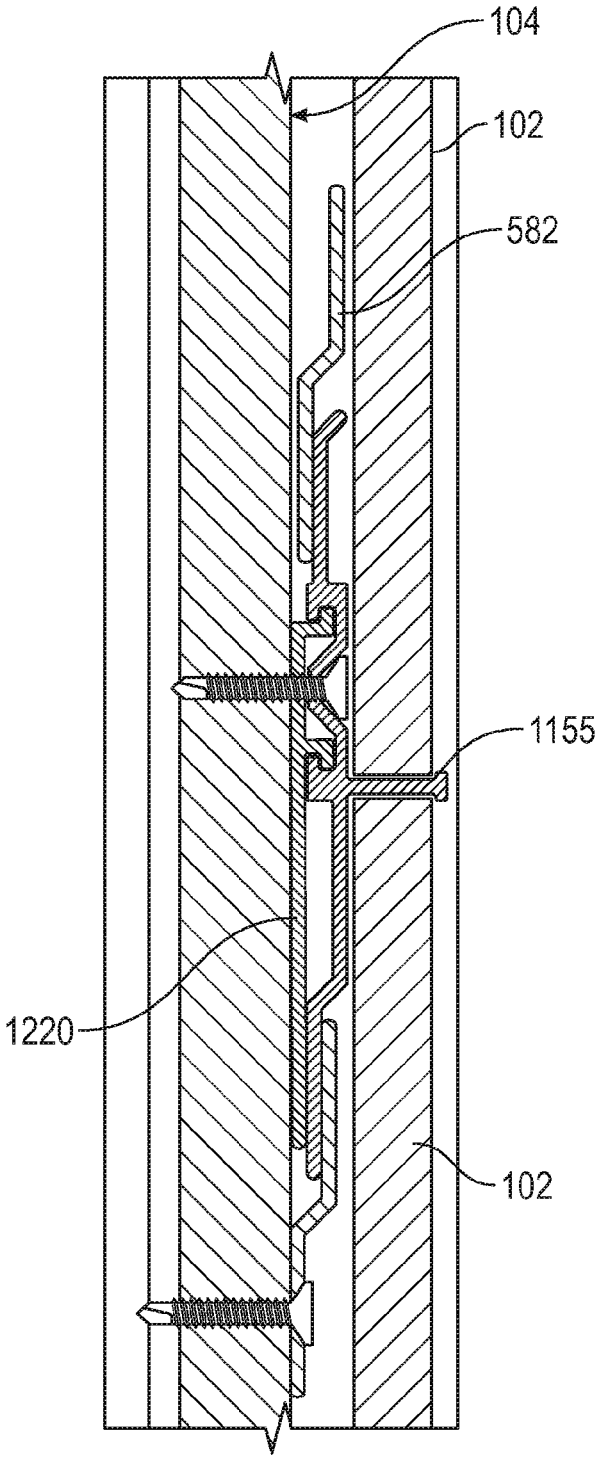
FIG. 15B is another sectional side end view of the wall cladding system of FIG. 1.
Figure 15C:
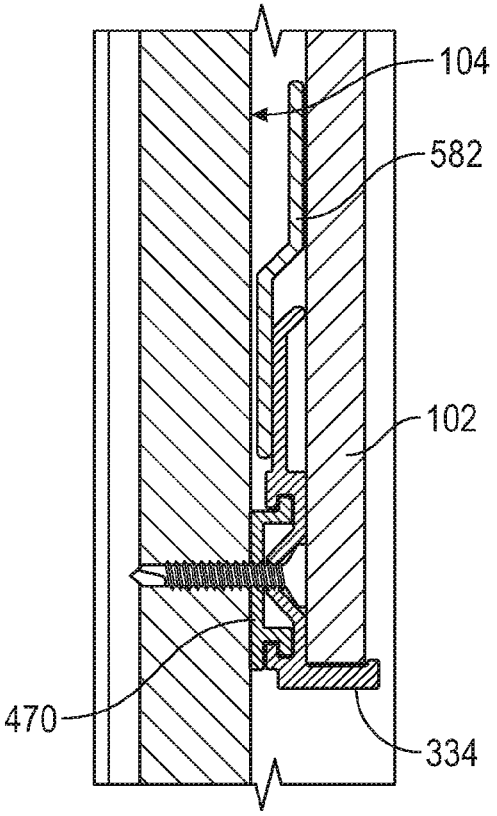
FIG. 15C is another sectional side end view of the wall cladding system of FIG. 1.

Moreover, as illustrated in FIG. 15C, during this same sliding motion, a portion of the joggle 582 secured to the panel 102 slides within the gap defined between the back surface 362 of the support extension 356 of the horizontal support 334 and the surface 104. In some aspects, this includes positioning either the first portion 598 or the second portion 501 of the joggle 582 secured to the panel 102 within the gap, depending on the portion of the joggle 582 secured to the panel 102 is in contact with the panel 102 and the portion spaced apart from the panel 102. The body 336 of the horizontal support 334 (or panel support 1155) frames the bottom edge 1252 of the panel 102 when installed.

Figure 14G:
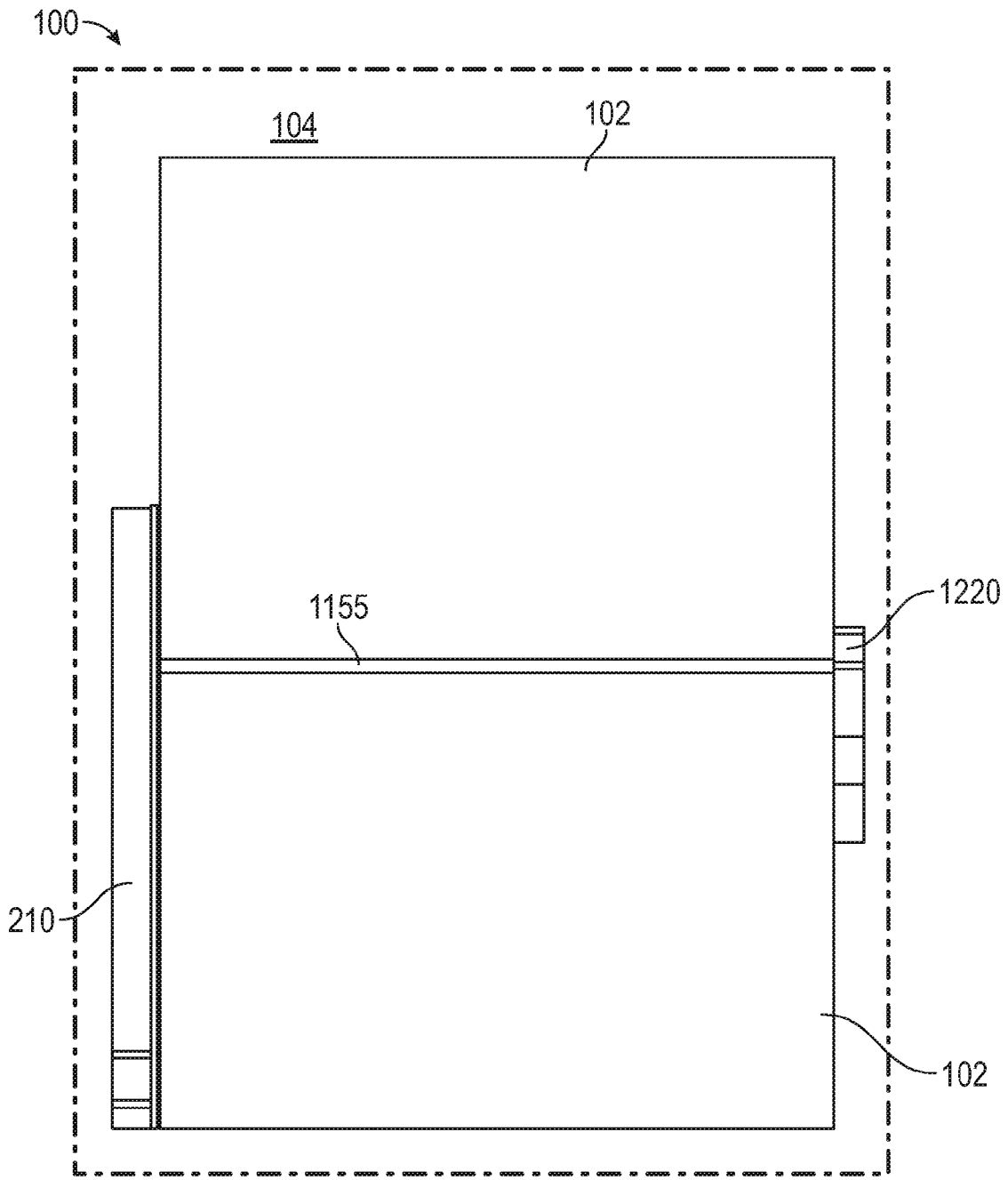
FIG. 14G is another perspective view of the wall cladding system of FIG. 14A.
Figure 14H:
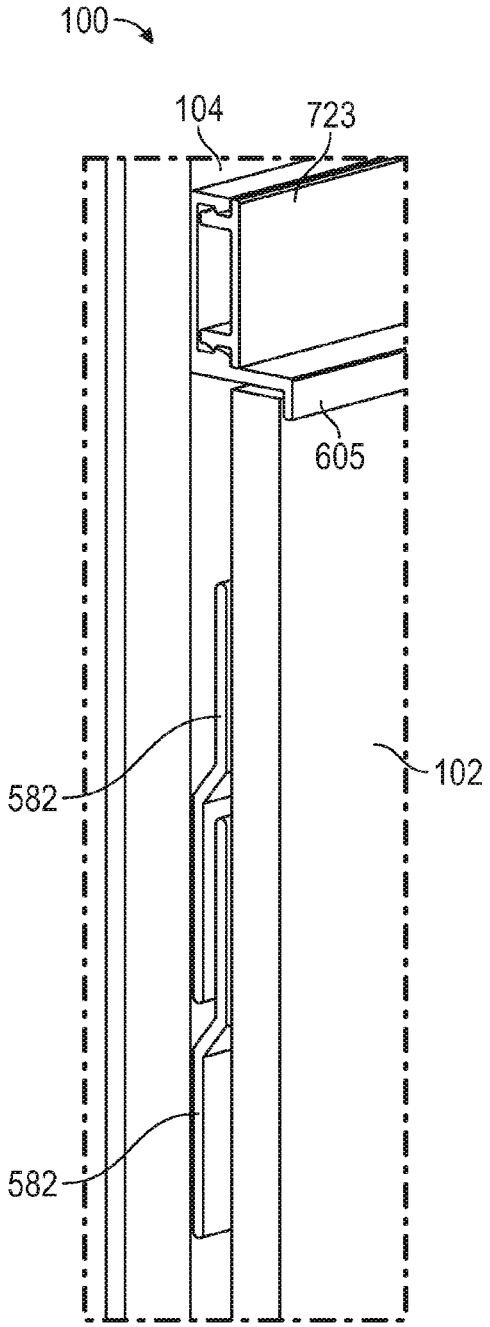
FIG. 14H is a partial perspective view of the wall cladding system of FIG. 14A.

This installation process is repeated for consecutive panels 102 mounted vertically up the wall, as illustrated in FIG. 14G.

The top-most panel 102 in a vertical column of panels 102 includes an upper and lower joggle 582 secured to the panel 102. A panel support 1155 and panel insert 1220 is not provided on the top-most panel 102 in a vertical column. When the top-most panel 102 is installed, the upper joggle 582 engages and slides within the gap defined by the joggle 582 secured to the surface 104, as illustrated for example in FIGS. 14H and 15A. The lower joggle 582 engages and slides within the gap defined between the surface 104 and the exposed portion of the panel support 1155 extending from the panel 102 below the top-most panel 102 (as discussed above).

After the top-most panel 102 is mounted on the wall cladding system 100, the top support 605 can be secured to the surface 104. Optionally, the front lip 617 overlaps a portion of a front surface 1246 of the panel 102 so as to frame the top edge 1250 of the panel 102 (see FIG. 14H). In this manner, uneven or misaligned panels 102 can be hidden from view. Moreover, the top support 605 is typically, but does not have to be, provided as a single, continuous top support 605 running continuously over a number of columns of panels 102 for the entire width of the installation. In other examples, the top support 605 is provided in segments having approximately the same horizontal dimension of the panels 102 when installed. In further examples, the top support 605 can have greater horizontal dimensions than the panels 102, for example to cover multiple columns of panels 102.

The top support 605 can be secured through various securing mechanisms including, but not limited to, fasteners, adhesives, glues, pins, and various other suitable securing mechanisms. For example, in some examples, an adhesive can be provided on a portion of the cap backing 619 that abuts the surface 104. In other examples, a fastener can be positioned through the cap backing 619. After the top support 605 is secured to the surface 104, the cap 723 can be secured to the top support 605 by positioning the cap extensions 727 of the cap 723 within the cap-securing channel 621 of the top support 605.

In various examples, after a column of panels 102 are secured to the surface 104, the process is repeated outwardly from the column to the right and/or left of the column of panels 102. In some examples, the vertical end 829, interior corner 943, and/or exterior corner 1045 may be utilized along the first side edges 1254 and/or second side edges 1256 of the panels 102 depending on whether the edges are at a corner of the surface 104 or at an end of the installation. The panels 102 and framing of the wall cladding system 100 are further designed and configured to be field cut around wall penetrations such as doors, windows, and various other types of wall penetrations.

Figure 16A:
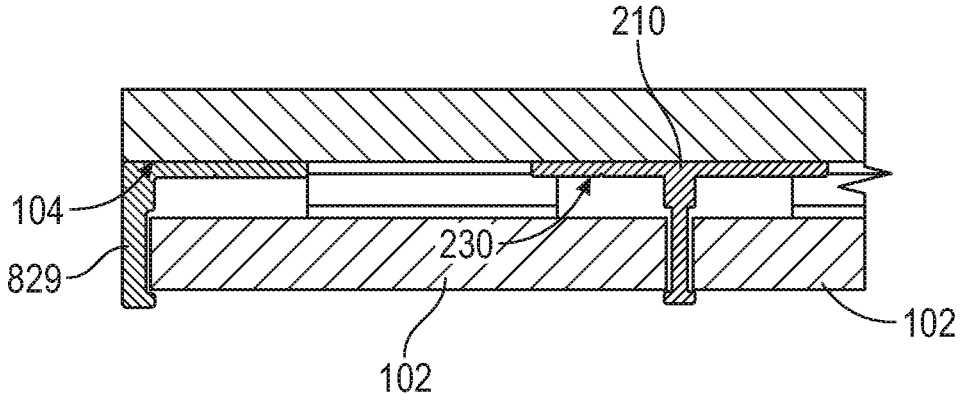
FIG. 16A is a sectional top end view of the wall cladding system of FIG. 1.
Figure 16B:
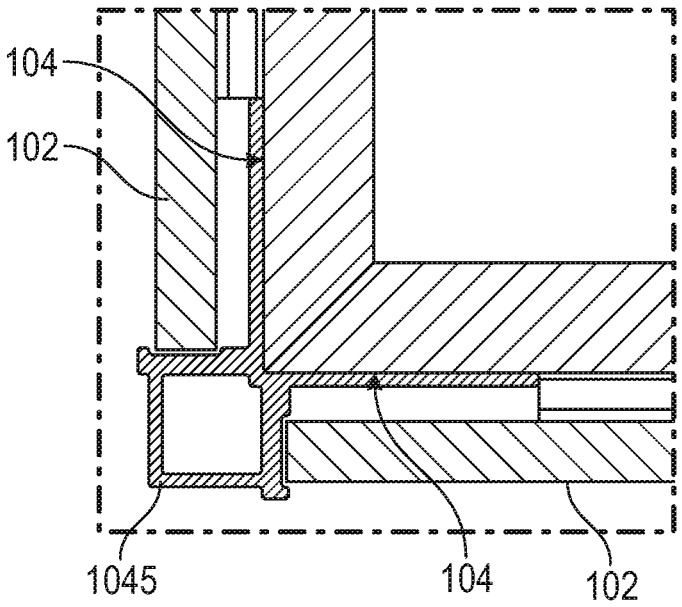
FIG. 16B is another sectional top end view of the wall cladding system of FIG. 1.
Figure 16C:
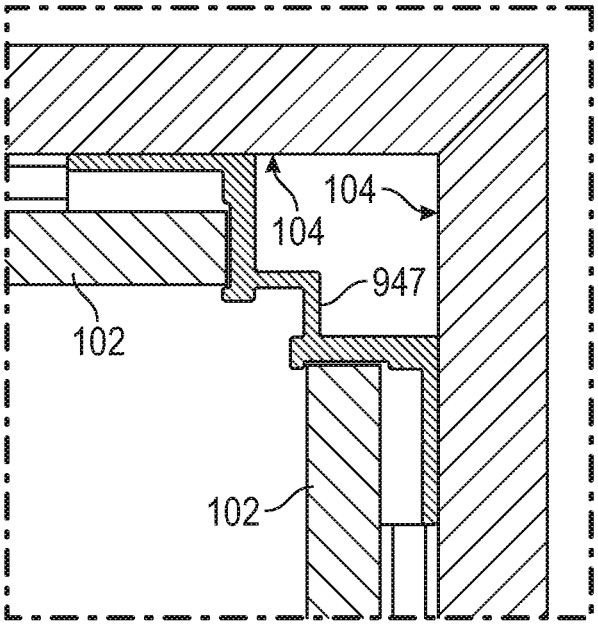
FIG. 16C is another sectional side top view of the wall cladding system of FIG. 1.

FIGS. 16A-C illustrate sectional top views of the wall cladding system 100 according to various examples. More specifically, FIG. 16A illustrates use of vertical end 829. As will be appreciated, vertical support 210 is designed to accommodate the positioning of panels 102 on each side of the upstanding body 212. Vertical ends 829 are used for framing and supporting a single panel 102, such as those provided on the extreme outer vertical edges of an installation. FIGS. 16B and 16C respectively illustrate use of an exterior corner 1045 and an interior corner 943 in installation examples.

In various examples, the panels 102 can be phenolic panels 102 constructed from a solid phenolic resin that is fire retardant. In various other examples, the panels 102 may be constructed from various other materials suitable for cladding the surface 104. In some examples, the panels 102 may be constructed to have various physical properties. For example and without limitation, in some cases, the panels 102 are constructed to have a smoke development index that is less than 450 as measured by ASTM E-84, a flame spread index that is less than 10 as measured by ASTM E-84, pass the NFPA268 Surface Ignition test, have an ignition temperature greater than 650 degrees Fahrenheit above ambient as measured by ASTM D1929, be impact resistant as measured by EN-ISO 178, and/or be scratch resistant per EN-438-6. In various other examples, the panels 102 may be constructed to have various other physical properties.

The various components of the wall cladding system 100 used to support the panels 102 may be constructed from various materials including, but not limited to, various metals (including but not limited to aluminum), plastics, composites, and other suitable materials.

It should be emphasized that the above-described aspects are merely possible examples of implementations, merely set forth for a clear understanding of the principles of the present disclosure. Many variations and modifications can be made to the above-described example(s) without departing substantially from the spirit and principles of the present disclosure. All such modifications and variations are intended to be included herein within the scope of the present disclosure, and all possible claims to individual aspects or combinations of elements or steps are intended to be supported by the present disclosure. Moreover, although specific terms are employed herein, as well as in the claims which follow, they are used only in a generic and descriptive sense, and not for the purposes of limiting the described invention, nor the claims which follow.

That which is claimed:

1. A wall cladding system for installation on a mounting surface, the system comprising:

a panel having a bottom edge and a side edge adjacent the bottom edge;

a vertical support configured to be mounted on the mounting surface and comprising a body with a surface defining a vertical expansion groove configured to receive the side edge of the panel;

a lower horizontal support configured to be oriented on the mounting surface so as to extend substantially perpendicular to the vertical support, wherein the lower horizontal support comprises a body with a surface defining a horizontal expansion groove configured to receive the bottom edge of the panel;

a joggle configured to be mounted on the mounting surface and comprising a first portion, a second portion laterally offset from, but substantially parallel to, the first portion, and a transition portion extending between the first portion and the second portion at a non-zero angle with respect to the first portion and the second portion, wherein the first portion is secured to the mounting surface, and wherein the second portion is spaced a distance from the mounting surface such that a slot is defined between the second portion of the joggle and the mounting surface;

an upper horizontal support secured to a back surface of the panel, wherein the upper horizontal support comprises:

a body comprising a top surface defining a first upper horizontal support expansion groove, and a bottom surface defining a second upper horizontal support expansion groove configured to receive a top edge of the panel; and a joggle extension extending downwardly from the bottom surface of the body and comprising a first portion, a second portion laterally offset from, but substantially parallel to, the first portion, and a transition portion connecting the first and second portions, wherein the second portion abuts the back surface of the panel and wherein the first portion is spaced a distance from the back surface of the panel; and a panel insert that slidingly engages the upper horizontal support, wherein the slot is dimensioned to receive both the first portion of the joggle extension and a portion of the panel insert such that the portion of the panel insert is interposed between the first portion of the joggle extension and the mounting surface.

2. The wall cladding system of claim 1, wherein the surface of the body of the vertical support is a first side surface and the vertical expansion groove is a first vertical expansion groove, and wherein the body of the vertical support further comprises:

a second side surface opposite the first side surface and defining a second vertical expansion groove.

3. The wall cladding system of claim 1, wherein the lower horizontal support further comprises a securing channel, wherein the wall cladding system further comprises a base track configured to be mounted on the mounting surface and comprising two support extensions extending from a base track body, and wherein the support extensions are configured to engage the securing channel to secure the lower horizontal support to the base track.

4. The wall cladding system of claim 3, wherein the lower horizontal support is slidable along the support extensions of the base track.

5. The wall cladding system of claim 3, wherein at least a portion of the vertical support overlaps at least a portion of the lower horizontal support and at least a portion of the base track when the lower horizontal support is at a final position along the base track.

6. A method of installing a wall cladding system comprising:

securing at least one vertical support to a mounting surface;

securing a joggle to a mounting surface, wherein the joggle comprises a first portion and a second portion laterally offset from, but substantially parallel to, the first portion, and wherein the joggle is secured such that a slot is defined between the second portion of the joggle and the mounting surface; and supporting a panel on the mounting surface, wherein mounting the panel comprises:

orienting the panel relative to the joggle, wherein the panel comprises a horizontal support, the horizontal support comprising a bottom surface abutting a top edge of the panel and a joggle extension extending downwardly from the bottom surface, wherein the joggle extension comprises a first portion and a second portion laterally offset, but substantially parallel to, the first portion, wherein the second portion of the joggle extension abuts a back surface of the panel, and wherein the first portion of the joggle extension is spaced a distance from the back surface of the panel;

positioning the first portion of the joggle extension and a portion of a panel insert slidingly engaged with the horizontal support within the slot such that the portion of the panel insert is interposed between the first portion of the joggle extension and the mounting surface;

sliding the panel insert within the slot and relative to the horizontal support and relative to the mounting surface such that the panel insert abuts the vertical support; and sliding the horizontal support along the panel insert and with the first portion of the joggle extension within the slot such that the horizontal support abuts the vertical support.

7. The method of claim 6, further comprising securing a lower horizontal support defining a securing channel to the mounting surface by:

mounting a base track to the mounting surface, wherein the base track comprises support extensions;

engaging the support extensions of the base track with the securing channel of the lower horizontal support to secure the lower horizontal support to the mounting surface; and sliding the horizontal support along the base track to position the horizontal support at a desired position relative to the base track.

8. The method of claim 6, wherein the panel is a first panel, and wherein the method further comprises mounting a second panel above the first panel such that the horizontal support extends along a lower edge of the second panel and a side edge of the second panel abuts the vertical support.

9. The method of claim 8, further comprising securing a top support to the mounting surface such that a front lip of the top support overlaps a portion of a front surface of the second panel proximate to a top edge of the second panel.

10. The method of claim 8, wherein the method further comprises mounting a third panel horizontally adjacent to the first panel such that the vertical support is between the first panel and the third panel and a side edge of the third panel abuts the vertical support.

11. The method of claim 10, further comprising mounting a fourth panel above the third panel such that a side edge of the fourth panel abuts the vertical support, wherein the fourth panel is horizontally adjacent to the second panel.

12. The method of claim 11, wherein the first panel and the second panel are supportively engaged, wherein the third panel and the fourth panel are supportively engaged, wherein the first panel is supportively disengaged from the third panel and the fourth panel, and wherein the second panel is supportively disengaged from the third panel and the fourth panel.

13. The method of claim 6, further comprising securing a top support to the mounting surface such that a front lip of the top support overlaps a portion of a front surface of the panel proximate to a top edge of the panel.

14. A wall cladding system for installation on a mounting surface, the system comprising:

a panel;

a joggle comprising a first portion and a second portion laterally offset from, but substantially parallel to, the first portion, wherein the first portion is securable to the mounting surface such that a slot is defined between the second portion of the joggle and the mounting surface;

a horizontal support comprising a body comprising a bottom surface configured to abut a top edge of the panel and a joggle extension extending downwardly from the bottom surface of the body, wherein the joggle extension comprises a first portion and a second portion laterally offset from, but substantially parallel to, the first portion, wherein the second portion of the joggle extension abuts a back surface of the panel, and wherein the first portion of the joggle extension is spaced a distance from the back surface of the panel; and a panel insert slidingly engaged with the horizontal support, wherein the slot is dimensioned to receive both the first portion of the joggle extension and a portion of the panel insert such that the portion of the panel insert is interposed between the first portion of the joggle extension and the mounting surface.

15. The wall cladding system of claim 14, further comprising a vertical support configured to be mounted on the mounting surface, wherein the vertical support is configured to abut a side edge of the panel, the horizontal support, and the panel insert, and wherein the vertical support comprises a profile with opposing vertical surfaces, each vertical surface comprising a vertical continuous relief groove defining a relief space that accommodates expansion and contraction of the panel.

16. The wall cladding system of claim 15, further comprising a lower horizontal support configured to be oriented on the mounting surface so as to extend substantially perpendicular to the vertical support, wherein the lower horizontal support is configured to abut a bottom edge of the panel such that the panel is vertically between the horizontal support and the lower horizontal support.

17. The wall cladding system of claim 14, wherein the panel is a first panel and the joggle is a first joggle, and wherein the system further comprises:

a second joggle vertically above the first panel, the second joggle comprising a first portion and a second portion laterally offset from, but substantially parallel to, the first portion, wherein the first portion is secured to the mounting surface; and a second panel supported on the second joggle such that the horizontal support abuts a bottom edge of the second panel.

18. The wall cladding system of claim 17, wherein the second panel comprises a panel joggle, wherein the panel joggle comprises a first portion and a second portion laterally offset from, but substantially parallel to, the first portion, wherein the first portion of the panel joggle is secured to a back surface of the second panel, wherein the second portion of the panel joggle is spaced a distance from the back surface, and wherein the second panel is supported on the second joggle such that the second portion of the panel joggle is interposed between the second portion of the second joggle and the mounting surface.

19. The wall cladding system of claim 14, wherein the body of the horizontal support comprises a top surface, and wherein the horizontal support further comprises a securing extension extending upwardly from the top surface of the body, wherein a back surface of the securing extension defines a securing channel, and wherein the panel insert is slidingly engaged with the horizontal support through the securing channel.

20. The wall cladding system of claim 19, wherein the securing extension of the horizontal support comprises a top edge, wherein the horizontal support further comprises a support extension extending upwardly from the top edge of the securing extension, wherein the support extension comprises a first portion and a second portion, and wherein the second portion is angled at a non-zero angle with respect to the first portion and is configured to abut a back surface of a second panel such that the second panel is spaced apart from the first portion.

* * * * *